US008170449B2

(12) United States Patent
Kami et al.

(10) Patent No.: US 8,170,449 B2
(45) Date of Patent: May 1, 2012

(54) IMAGE FORMING APPARATUS AND PROCESS CARTRIDGE

(75) Inventors: Hidetoshi Kami, Numazu (JP); Yukio Fujiwara, Numazu (JP); Kazuhiro Egawa, Numazu (JP)

(73) Assignee: Ricoh Company Ltd., Tokyo (JP)

( * ) Notice: Subject to any disclaimer, the term of this patent is extended or adjusted under 35 U.S.C. 154(b) by 410 days.

(21) Appl. No.: 12/389,551

(22) Filed: Feb. 20, 2009

(65) Prior Publication Data

US 2009/0208246 A1 Aug. 20, 2009

(30) Foreign Application Priority Data

Feb. 20, 2008 (JP) ..... 2008-038335

(51) Int. Cl.
*G03G 5/047* (2006.01)

(52) U.S. Cl. ..... 399/159; 430/58.7; 430/59.6; 430/66

(58) Field of Classification Search ..... 430/58.7, 430/59.6, 66; 399/159
See application file for complete search history.

(56) References Cited

U.S. PATENT DOCUMENTS

| | | | | |
|---|---|---|---|---|
| 5,707,767 | A * | 1/1998 | Yu | 430/58.1 |
| 6,861,188 | B2 | 3/2005 | Ikegami et al. | |
| 6,936,388 | B2 | 8/2005 | Suzuki et al. | |
| 7,018,755 | B2 | 3/2006 | Ikegami et al. | |
| 7,160,658 | B2 | 1/2007 | Suzuki et al. | |
| 7,267,916 | B2 | 9/2007 | Sugino et al. | |
| 7,314,693 | B2 | 1/2008 | Ikegami et al. | |
| 7,381,511 | B2 | 6/2008 | Ikegami et al. | |
| 2002/0197549 | A1 | 12/2002 | Sakon et al. | |
| 2003/0104295 | A1 | 6/2003 | Niimi | |
| 2004/0165919 | A1 * | 8/2004 | Nishida | 399/346 |
| 2004/0248024 | A1 * | 12/2004 | Suzuki et al. | 430/66 |
| 2007/0031746 | A1 | 2/2007 | Toshine et al. | |
| 2007/0196749 | A1 | 8/2007 | Inaba et al. | |

(Continued)

FOREIGN PATENT DOCUMENTS

JP 8-234471 9/1996

(Continued)

OTHER PUBLICATIONS

Hyakutake, Nobuo, et al., "Blade cleaning system for polymerized and small size toner", Japan Hardcopy Fall Meeting, pp. 24-27, 2001.

(Continued)

*Primary Examiner* — Peter Vajda
(74) *Attorney, Agent, or Firm* — Cooper & Dunham LLP

(57) ABSTRACT

An image forming apparatus including an image bearing member which has an electroconductive substrate, a photosensitive layer overlying the electroconductive substrate and a cross-linked resin surface layer overlying the photosensitive layer and bears a latent electrostatic image on the surface thereof, an application device to apply a solid lubricant to the image bearing member; a charging device to charge the surface of the image bearing member, an irradiation device to irradiate the surface of the image bearing member with light to form the latent electrostatic image thereon, a development device to develop the latent electrostatic with toner to obtain a developed image, a transfer device to transfer the developed image to a recording medium, and; a cleaning device to clean the surface of the image bearing member, wherein the cross-linked resin surface layer includes a cross-linked body of trimethylol propane triacrylate and particulates including silicon and an average diameter of agglomeration areas of the particulates containing silicon on the surface of the cross-linked resin surface layer is from 0.5 to 2.2 μm.

6 Claims, 9 Drawing Sheets

U.S. PATENT DOCUMENTS

| | | | |
|---|---|---|---|
| 2007/0196750 | A1 | 8/2007 | Fujiwara et al. |
| 2007/0212626 | A1 | 9/2007 | Toshine et al. |
| 2008/0085459 | A1 | 4/2008 | Kami et al. |
| 2008/0138725 | A1 | 6/2008 | Fujiwara et al. |
| 2008/0153021 | A1 | 6/2008 | Ikuno et al. |
| 2008/0199217 | A1 | 8/2008 | Iwamoto et al. |
| 2008/0227008 | A1 | 9/2008 | Kami et al. |
| 2008/0311499 | A1 | 12/2008 | Kami et al. |

FOREIGN PATENT DOCUMENTS

| | | |
|---|---|---|
| JP | 8-248663 | 9/1996 |
| JP | 8-314174 | 11/1996 |
| JP | 2000-66424 | 3/2000 |
| JP | 2000-171990 | 6/2000 |
| JP | 3733237 | 10/2005 |
| JP | 2006-250989 | 9/2006 |
| JP | 2007-79244 | 3/2007 |
| JP | 3927888 | 3/2007 |
| JP | 4194973 | 10/2008 |

OTHER PUBLICATIONS

European Patent Office, Extended European Search Report (Jun. 3, 2009), European Patent Application No. 09153243.2-1217, Ricoh Company, Ltd.

* cited by examiner

IMAGE FORMING APPARATUS AND PROCESS CARTRIDGE

BACKGROUND OF THE INVENTION

1. Field of the Invention

The present invention relates to an image forming apparatus and a process cartridge.

2. Discussion of the Background

Among the image bearing members applied to photocopiers, laser printers, etc., inorganic image bearing members formed of selenium, zinc oxide, cadmium sulfide, etc. used to be the mainstream. However, organic image bearing members (photoconductors: OPC) are now dominant over the inorganic image bearing members since the organic image bearing members are advantageous in terms of the burden on the global environment, cost reduction, free latitude of designing, etc. The production ratio of the organic image bearing member is almost 100% of the total production of the image bearing member. Such organic image bearing members are required to shift from a disposal supply product to a mechanical part upon the ground swell of the global environmental protection.

Various kinds of improvements on the durability of the organic image bearing member have been attempted so far. Among these, a technology of forming a cross-linked resin layer {for example, unexamined published Japanese patent application No. (hereinafter referred to as JOP) 2000-66424} or a sol-gel cured layer (for example, JOP 2000-171990) on the surface of an image bearing member especially shows promise. The former technology is advantageous in that cracking hardly occurs when a charge transport component is blended, which leads to improvement on the yield ratio. Especially, radical polymerizable acrylic resins are suitable to manufacture a strong and highly sensitive image bearing member. Since the layer of the two technologies employing the cross-linked structure is formed by multiple chemical linkages, the surface is not immediately abraded when part of the chemical linkages is severed under the stress on the layer.

On the other hand, the toner for use in electrophotography is suitable in terms of ecologies relating to manufacturing and improvement on image quality. Therefore, using a polymerization toner (spherical toner) is popular these days.

This polymerization toner (spherical toner) is not angular but round and manufactured by a chemical manufacturing method such as a suspension polymerization method, an emulsification agglomeration method, an esterification elongation polymerization method, a dissolution suspension method, etc. The form of the polymerization toner depends on the manufacturing method. The polymerization toner for use in an image forming apparatus is slightly irregular shaped in comparison with a sphere. The polymerization toner has characteristics such as an average circularity of 0.95 to 0.99 and shape factors SF-1 and SF-2 of from 110 to 140. A sphere has an average circularity of 1.0 and shape factors SF-1 and SF-2 of 100.

Since the polymerization toner has a uniform shape, the amount of charge held thereby is relatively uniform. In addition, waxes (5 to 10%), etc. can be easily internally added to the polymerization toner. Therefore, since the polymerization toner hardly strays out of a latent electrostatic image, the polymerization toner has a good development property and transfer efficiency, and is suitable for producing sharp images having a high definition and excellent graduation. In addition, oil is unnecessary for image transfer. However, this kind of toner has bad cleaning property and the addition amount of external additives inevitably increases due to the employment of the oil-free system. This may cause filming having a killifish form on an image bearing member. A number of studies have been made to deal with this problem and a great number of technologies therefor are described in patent documents.

Generally, image bearing members using a polymerization toner are desired to have and maintain a low surface friction index for repeated use to obtain a good cleaning property of the polymerization toner. For example, a technology is known which improves the cleaning property of a polymerization toner by applying a solid lubricant such as zinc stearate to the surface of the image bearing member (for example, Nobuo Momotake, Akihisa Maruyama and Satoshi Shigesaki, Japan Hardcopy Fall Meeting, 24-27, 2001)

The technology concept for improving the durability by containing a filler in a resin layer forming the surface layer of an organic image bearing member is well known. For example, JOP 2007-79244 describes a technology in which silicon resin particulates (Example 2) or aluminum particulates (Examples 3 to 5) are contained in resin liquid application for the surface layer as a filler. JOP 2005-99688 describes a technology in which aluminum particulates (Examples 1 and 7 to 15), silica particulates (Example 2), titanium oxide particulates (Example 3), DLC and non-crystal carbon particulates (Example 4), fullerene particulates (Example 5), or colloidal silica (Example 6) is contained as a filler. JOP 2006-250989 describes a technology in which aluminum particulates (Examples 30, 31 and 46) are contained as a filler. JOP H08-234471 describes a technology in which particulates having silicon atoms having small particle diameter and silicon atoms having a large particle diameter are contained as a filler (Examples 1 to 4). JOP H08-314174 describes a technology in which two kinds of silica particulates having different specific gravities or two different kinds of complex metal oxide particulates are contained as a filler. JOP 2004-78113 describes a technology in which electroconductive particles (zinc oxide, titanium oxide, tin oxide, antimony oxide, indium oxide, bismuth oxide, indium oxide in which tin is doped, tin oxide in which antimony is doped, and zirconium oxide in which antimony is doped) are contained.

When a solid lubricant such as zinc stearate is externally supplied to a highly durable image bearing member in which radical polymerizable acryl cross-linked layers are accumulated (refer to JOP H11-288194 with regard to the external supply of a solid lubricant), a problem arises that the solid lubricant is not sufficiently accepted to the surface of the image bearing member. The surface of this kind of image bearing member is too smooth to observe concave-convex portions. Therefore, this problem is considered to stem from this surface smoothness of the image bearing member. By contrast, JOP 2007-79244 describes a technology of stably supplying a lubricant to the surface of an image bearing member by roughening the surface. To be specific, an image bearing member having a surface roughness (Rz: JIS 1994) of from 0.4 to 1.0 μm is advantageous and an addition of a filler to the surface layer is suitable to maintain a specific surface roughness thereof for such an image bearing member.

However, the rough surfaces can be various even when image bearing members have the same Rz value. For example, image bearing members having an extremely different concave and convex distance may have the same Rz value. The acceptability of an image bearing member for a solid lubricant may have order of precedence among image bearing members having the same Rz value. To improve the acceptability of an image bearing member for a solid lubricant, a specific condition other than the Rz value is required.

Furthermore, the addition of a filler to the surface layer involves the next problem. Aluminum particulates are used in Examples of JOP 2007-79244. Since the filler dispersability of the aluminum particulates in a liquid application is unstable, some device is required for the layer forming conditions. In another Example in which polymethyl silsesquioxane particulates are used, the acceptability of a solid lubricant on the surface of an image bearing member is not necessarily sufficient. This is considered to be because the surface of the image bearing member is significantly rough so that the image bearing member does not sufficiently bear the solid lubricant.

The liquid application for a cross-linked resin surface layer has a low viscosity because the liquid application is mainly formed of a monomer composition. However, since particulates containing silicon such as silica or silicone resin particulates are generally stably dispersed in the liquid application for a cross-linked resin surface layer, the particulates containing silicon have advantages among various kinds of fillers in terms of manufacturing. JOP 2005-99688 describes an example using particulates containing silicon. However, the acceptability of a solid lubricant on the surface of an image bearing member is not necessarily sufficient in this case. This is also considered to be because the surface of the image bearing member is significantly rough so that the image bearing member does not sufficiently bear the solid lubricant. Thus, addition of another technology is desirable.

In addition, JOP H08-248663 describes a technology in which inorganic particulates (hydrophobized silica) having an average particle diameter of from 0.05 to 0.5 μm are dispersed with a thickness of from 0.05 to 15 μm in the photosensitive layer having a surface roughness of from 0.1 to 0.5 μm formed on the electroconductive substrate having a surface roughness of from 0.01 to 2 μm.

This technology is to improve the durability of an image bearing member and prevent the definition decrease caused by attachment of contamination material such as corona products by hydrophobizing silica particles to be dispersed. In this technology, droplets are shed (i.e., contact angle is large) due to the hydrophobized inorganic particulates. However, the attachment of the corona product is not prevented so that the image flow is not prevented. JOP 2004-138643 describes a technology of using aluminum as a filler to avoid occurrence of image flow. However, as described above, filling aluminum in a cross-linked surface layer causes a manufacturing problem. Therefore, it is difficult to use aluminum as it is as a filler.

In an image forming apparatus in which a solid lubricant is externally supplied to the surface of the image bearing member, the acceptability of an image bearing member for a solid lubricant has an impact on the abrasion speed of the image bearing member, the cleaning property of toner and thereby on the image quality.

SUMMARY OF THE INVENTION

Because of these reasons, the present inventors recognize that a need exists for an image forming apparatus which has a highly durable image bearing member formed of a cross-linked resin surface layer having good acceptability for a solid lubricant and maintains good cleaning property when a polymerization toner is used.

Accordingly, an object of the present invention is to provide an image forming apparatus which has a highly durable image bearing member formed of a cross-linked resin surface layer having good acceptability for a solid lubricant and maintains good cleaning property when a polymerization toner is used.

Briefly this object and other objects of the present invention as hereinafter described will become more readily apparent and can be attained, either individually or in combination thereof, by an image forming apparatus including an image bearing member which has an electroconductive substrate, a photosensitive layer overlying the electroconductive substrate and a cross-linked resin surface layer overlying the photosensitive layer and bears a latent electrostatic image on the surface thereof, an application device to apply a solid lubricant to the image bearing member; a charging device to charge the surface of the image bearing member, an irradiation device to irradiate the surface of the image bearing member with light to form the latent electrostatic image thereon, a development device to develop the latent electrostatic with toner to obtain a developed image, a transfer device to transfer the developed image to a recording medium, and; a cleaning device to clean the surface of the image bearing member, wherein the cross-linked resin surface layer includes a cross-linked body of trimethylol propane triacrylate and particulates including silicon and an average diameter of agglomeration areas of the particulates containing silicon on the surface of the cross-linked resin surface layer is from 0.5 to 2.2 μm.

It is preferred that, in the image forming apparatus mentioned above, the occupation area ratio of the particulates containing silicon on the surface of the cross-linked resin surface layer is from 2 to 10%.

It is still further preferred that, in the image forming apparatus mentioned above, the particulates containing silicon in the cross-linked resin surface layer are mixed fillers containing at least two kinds of particulates containing silicon having a different average particle diameter, particulates containing silicon having a largest weight % of the mixed fillers has an average particle diameter of from 0.08 to 0.12 μm, and the mixed filler has an average particle diameter of from 0.10 to 0.70 μm.

It is still further preferred that, in the image forming apparatus mentioned above, the cross-linked resin surface layer comprises a cross-linked body of a cured charge transport material represented by the following Chemical structure 1 in an amount of from 5% by weight to less than 60% by weight;

Chemical structure 1

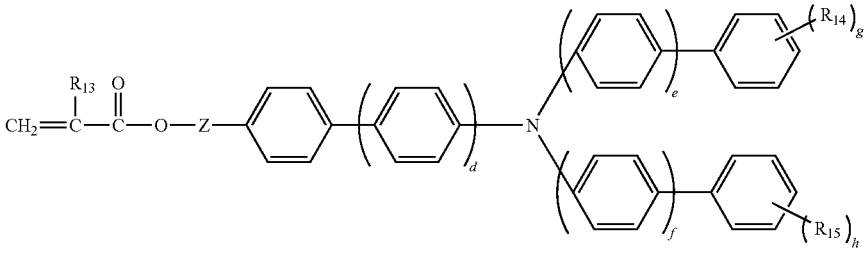

where d, e and f, each, independently represent 0 or 1, $R_{13}$ represents hydrogen atom or methyl group, $R_{14}$ and $R_{15}$, each, independently, represent an alkyl group having 1 to 6 carbon atoms, g and h, each, independently represent 0 or an integer of from 1 to 3, when g and h are 2 or 3, each of $R_{14}$ and $R_{15}$ can be independently different from each other, and Z represents a single bond, methylene group, ethylene group, —$CH_2CH_2O$—, —$CHCH_3CH_2O$— or a group represented by a following chemical formula:

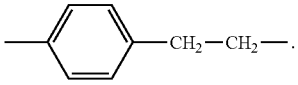

It is still further preferred that, in the image forming apparatus mentioned above, the particulates containing silicon having the largest weight % of the mixed fillers are hydrophobized amorphous silica.

It is still further preferred that, in the image forming apparatus mentioned above, the at least two kinds of particulates containing silicon having a different average particle diameter contains a spherical silica.

It is still further preferred that, in the image forming apparatus mentioned above, the solid lubricant is zinc stearate.

It is still further preferred that, in the image forming apparatus mentioned above, the toner is a polymerized toner.

As another aspect of the present invention, a process cartridge is provided which includes the image bearing member mentioned above and an application device to apply a solid lubricant to the image bearing member.

It is preferred that, in the process cartridge mentioned above, the solid lubricant is zinc stearate.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

The present invention relates to an image forming apparatus including an image bearing member and an application device which applies a solid lubricant thereto. The image bearing member has an electroconductive substrate on which a photosensitive layer and a cross-linked resin surface layer are provided and the cross-linked resin surface layer contains a cross-linked body of trimethylol propane triacrylate and particulates containing silicon. In addition, the average particle diameter of the agglomeration areas of the particulates containing silicon is from 0.5 to 2.2 μm.

The acceptability of the surface of an image bearing member for a solid lubricant varies depending on the surface form of the image bearing member. This is determined by the fact that image bearing members having different roughened surface have different acceptability of solid lubricant. Various kinds of methods (concepts) are described with regard to how to roughen the surface of an image bearing member. Among these, a method of blending an inorganic filler in the surface of an image bearing member is advantageous in terms of the durability and the stability of the rough surface form. A material which does not have an adverse impact on the electrostatic characteristics and mechanical strength of an image bearing member is suitably selected as the inorganic filler. In addition, in terms of manufacturing, a material having a highly stable dispersability in a liquid application is especially required as a material to avoid reducing a pot life of the liquid application.

To the contrary, when a radically polymerizable acrylic resin is used for the cross-linked resin layer, particulates containing silicon such as silica are confirmed to be effective. Silica is stably dispersed in a liquid application having a low viscosity and has advantages with regard to manufacturing and the cost. As described above, when silica is blended in the surface of an image bearing member, image blurs occur in most cases in a high temperature and humid environment and due to exposure to $NO_x$. Therefore, a device such as a drum heater is required in the image forming apparatus to adjust the moisture therein. However, it is surprisingly confirmed that a combinational use of particulates containing silicon and trimethylol propane triacrylate prevents occurrence of image flow in a high temperature and humid environment or due to exposure to $NO_x$.

Figure 1:
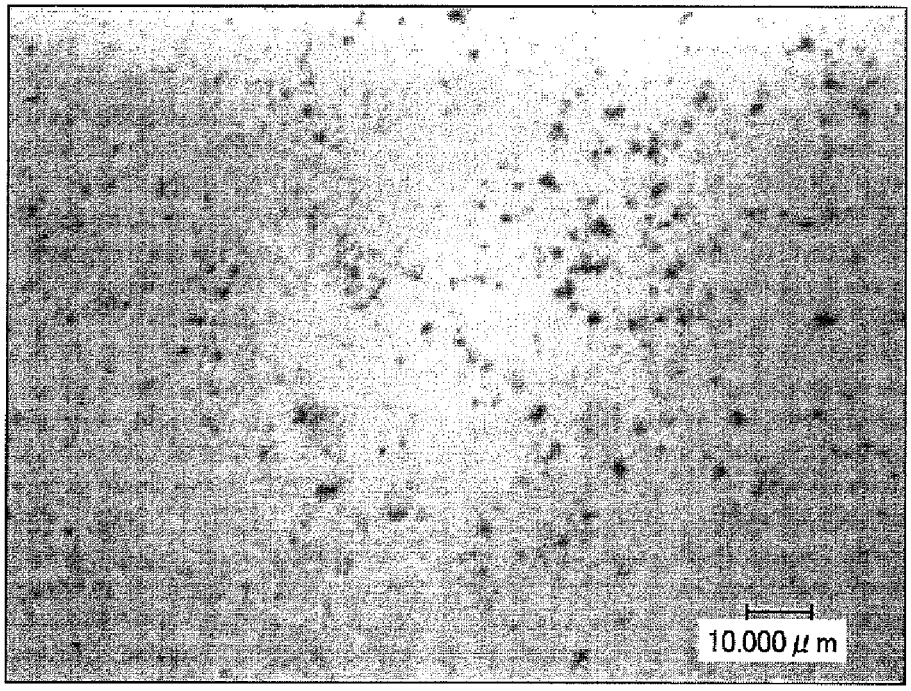
FIG. 1 is a photograph illustrating an example of the agglomeration area in the cross-linked resin surface layer of the image bearing member for use in the present invention.
Figure 2:
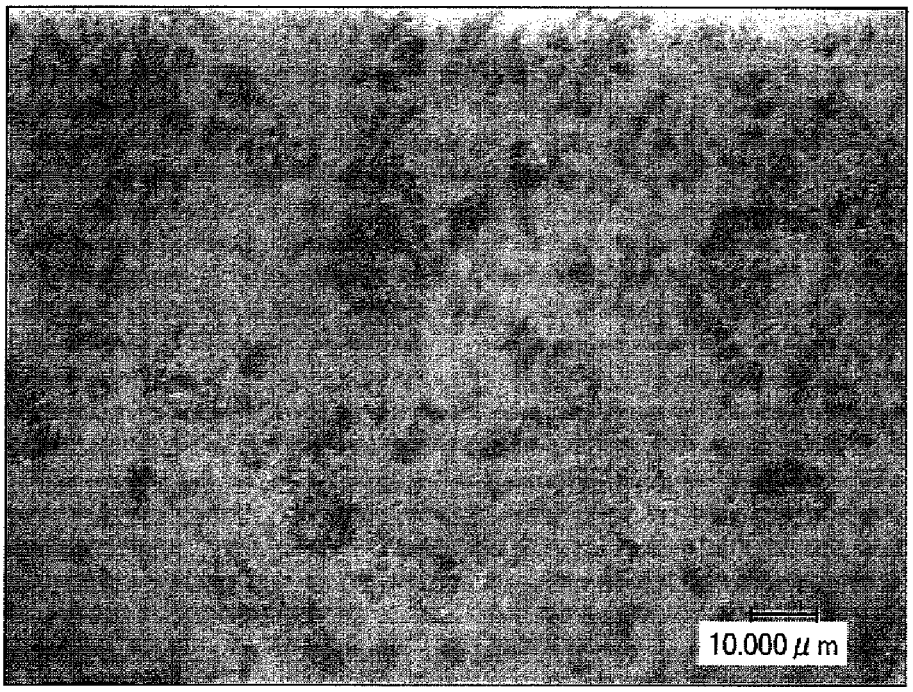
FIG. 2 is a photograph illustrating another example of the agglomeration area in the cross-linked resin surface layer of the image bearing member for use in the present invention.
Figure 3:
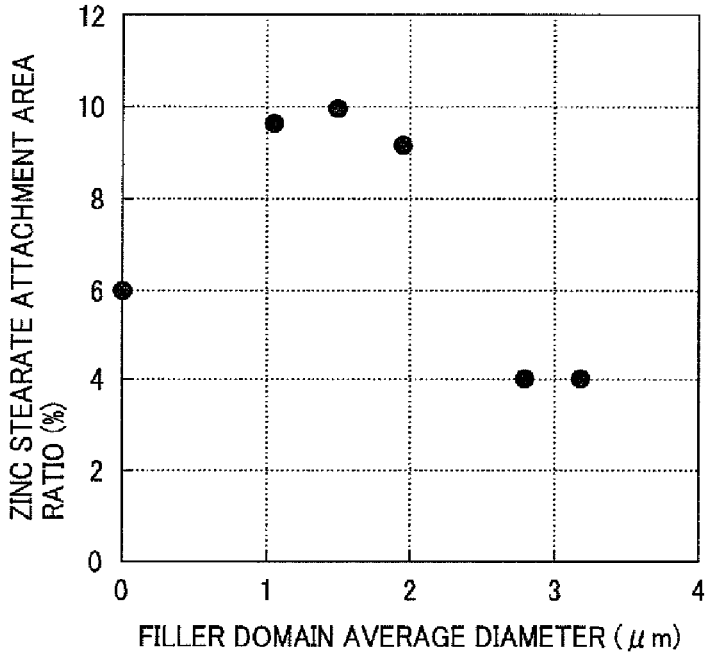
FIG. 3 is a graph illustrating an example of the relationship between the domain size and the attachment area of zinc stearate.

When a liquid application for cross-linked resin layer including particulates containing silicon is coated on the surface of an image bearing member, the particulates containing silicon are not simply dispersed in the layer but forms agglomeration areas (domain) having a particular size. FIGS. 1 and 2 are photographs illustrating such agglomeration areas. When the average diameter of the agglomeration area is defined as the domain size, the domain sizes in FIGS. 1 and 2 are 1.9 μm and 3.2 μm, respectively. Since particulates containing silicon having a primary particle diameter of not greater than 0.5 μm are used, the thick blocks are agglomeration bodies. FIG. 3 is a graph illustrating the relationship between the acceptability of the solid lubricant (zinc stearate) and the domain size of the mixed filler.

Figure 4:
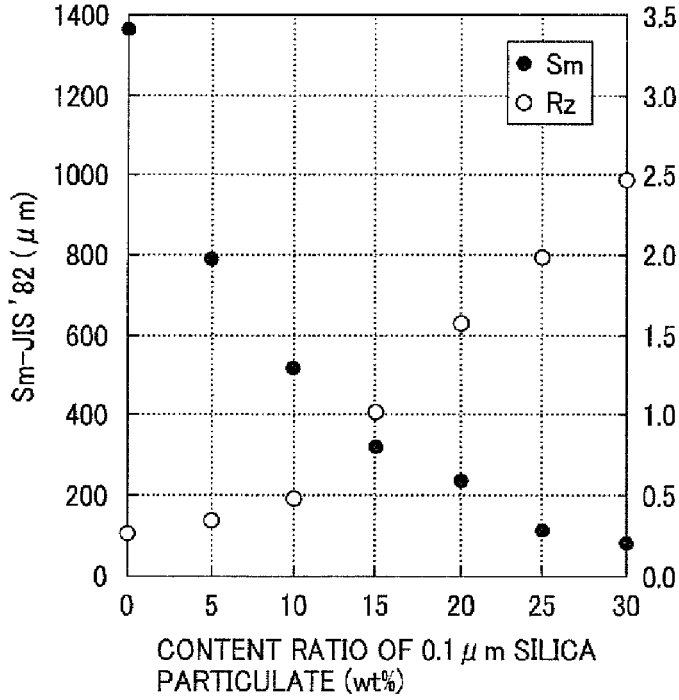
FIG. 4 is a graph illustrating an example of the relationship between Sm and Rz (Value of Ten-Point Height of Irregularities) with regard to the content ratio of silica particulates in the cross-linked resin surface layer.

To increase the acceptability of a solid lubricant on the surface of an image bearing member, the average diameter (D) of the domain size of the particulates containing silicon satisfies the following relationship: $0.5\ \mu m \leqq D \leqq 2.2\ \mu m$. When the domain size is excessively small, the acceptability of a solid lubricant on the surface of an image bearing member tends to be not sufficiently boosted by roughening the surface of the image bearing member. The mechanism of this phenomenon is not clear but it is inferred that the acceptability of a solid lubricant on the surface of an image bearing member is determined by a combination of the surface roughness and the distribution status of particulates containing silicon. When the domain size is too large, the swell (Sm) of the shape and the gap (Rz: Value of Ten-Point Height of Irregularities) between the top and the bottom fall off balance so that the acceptability of a solid lubricant is insufficient. Forming a domain suitable for having a good acceptability of a solid lubricant is difficult by simply adding the particulates containing silicon to the surface of an image bearing member. This is because the particulates containing silicon affects both the swell (Sm) of the shape and the gap (Rz) between the top and the bottom depending on the content of the particulates containing silicon. FIG. 4 is a graph illustrating an example of this relationship. The surface roughness is measured by using SURFCOM 1400D (manufactured by Tokyo Seimitsu Co., Ltd.).

However, only the value of Sm can be varied by a combinational use of particulates containing silicon having different particle diameters while fixing the value of Rz. Similarly, only the value of Rz can be varied while fixing the value of Sm. In the present invention, mixing particulates containing silicon having an average particle diameter of from 0.08 to 0.5 μm with another particulates containing silicon having an average particle diameter of from 0.08 to 0.5 μm is preferred. Furthermore, mixing such particulates containing silicon such that the content of particulates containing silicon having an average particle diameter of from 0.08 to 0.12 μm is the largest among all the particulates containing silicon is more preferred and helpful to form the domain size described above.

In addition, as the filler for use to obtain a surface shape suitable to improve the acceptability of a solid lubricant, it is preferred to hydrophobize the particulates containing silicon having the largest content ratio. The detail of this phenomenon is not clear but it is inferred that the hydrophobized particulates have a suitable wettability with other compositions including the other particulates containing silicon, which works to form a domain.

Therefore, a suitable domain size can be formed. Since the mixed filler is internally added to the cross-linked resin surface layer, the initial dispersion status of the mixed filler is maintained even when the surface of an image bearing member is abraded.

The image forming apparatus of the present invention contains an image bearing member having the cross-linked resin surface layer in which the mixed filler occupies an area ratio of from 2 to 10%.

The acceptability of a solid lubricant on the surface of an image bearing member is not improved by increasing the composition ratio of the particulates containing silicon. The occupation area of the mixed filler in the cross-linked resin surface layer is preferably from 2 to 10%. This is inferred as described above.

In the present invention, the image bearing member is observed by a laser microscope (VK-8500, manufactured by Keyence Corporation).

The average diameter of a projection image is an average of the diameters of particles or agglomeration bodies thereof (one agglomeration body is regarded as a particle) when the uppermost layer of the image bearing member is observed from a significantly vertical direction. The average diameter and the occupation area ratio of the mixed filler domain are calculated from an obtained photograph of the surface of the image bearing member using an image analysis software (Image-Pro Plus, manufactured by Media Cybernetics Inc.). The occupation areas of the filler of the photographs of FIGS. 1 and 2 are calculated as 6.5% and 23.5%, respectively.

The image forming apparatus of the present invention includes an image bearing member formed of a cross-linked resin surface layer in which a cross-linked body of the curing type transport material represented by the following Chemical structure (1) is contained in an amount of from 5 to less than 60% by weight.

Chemical structure 1

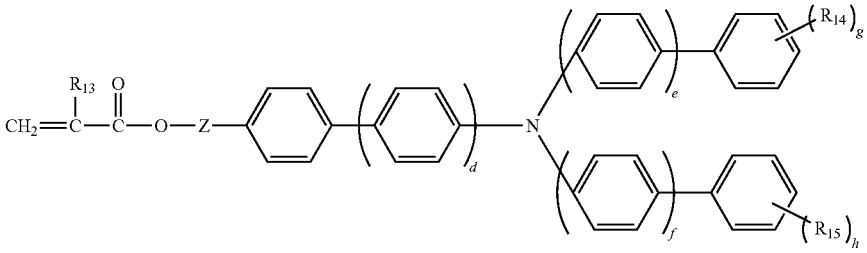

In the Chemical structure (1), d, e and f, each, independently, represent 0 or 1, $R_{13}$ represents hydrogen atom or methyl group, $R_{14}$ and $R_{15}$, each, independently, represent an alkyl group having 1 to 6 carbon atoms, g and h, each, independently, represent 0 or an integer of from 1 to 3, when g and h are 2 or 3, each of $R_{14}$ and $R_{15}$ can be independently different from each other, and Z represents a single bond, methylene group, ethylene group, $CH_2CH_2O$, $CHCH_3CH_2O$ or a group represented by the following chemical formula.

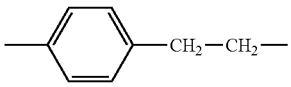

The charge transport material having the structure illustrated above is useful for an image bearing member using a cross-linked resin surface layer of a curing resin in terms of the sensitivity.

The image bearing member for use in the present invention is described in detail with reference to the accompanying drawings below.

Figure 6:
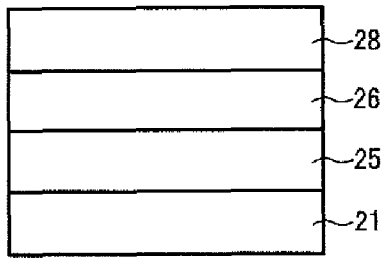
FIG. 6 is a cross-section illustrating an example of the layer structure of the image bearing member for use in the present invention.

FIG. 6 is a schematic diagram illustrating a cross section of an example of the layer structure of the image bearing member for use in the present invention, which has an electroconductive substrate 21 on which a charge generating layer 25, a charge transport layer 26 and a cross-linked resin surface layer 28 are provided in this sequence.

Figure 7:
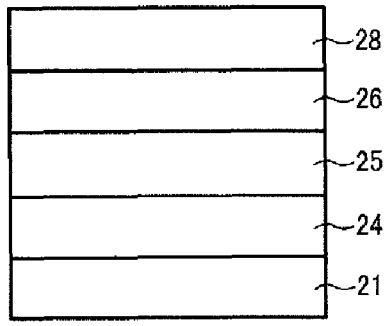
FIG. 7 is a cross-section illustrating another example of the layer structure of the image bearing member for use in the present invention.

FIG. 7 is a schematic diagram illustrating a cross section of another example of the layer structure of the image bearing member for use in the present invention, which has the electroconductive substrate 21 on which an undercoating layer 24, the charge generating layer 25, the charge transport layer 26 and the cross-linked resin surface layer 28 are provided in this sequence.

Electroconductive Substrate

Materials having a volume resistance of not greater than $10^{10}$ Ω·cm can be used as a material for the electroconductive substrate 21. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as a drawing ironing method, an impact ironing method, an extruded ironing method, an extruded drawing method, and a cutting method and thereafter subject to surface-treatment such as cutting, super finishing and grinding treatment can be also suitably used.

Undercoating Layer

The image bearing member for use in the present invention may have the undercoating layer 24 between the electroconductive substrate 21 and a photosensitive layer (the charging layer 25 and/or the charging transport layer 26). The undercoating layer 24 is provided to improve the adhesiveness, prevent moiré, improve the applicability of the layer provided above the undercoating layer 24, prevent infusion of the charge from the electroconductive substrate 21.

The undercoating layer is normally formed of a resin. Since a photosensitive layer is generally applied to the undercoating layer 24, a suitable resin for use in the undercoating layer 24 is a thermocuring resin hardly soluble in an organic solvent. Most of polyurethane resins, melamine resins and alkyd-melamine resins are especially preferred because these satisfy the purposes described above. Liquid application can be prepared by suitably diluting such a resin in a solvent such as tetrahydrofuran, cyclohexanone, dioxane, dichloroethane and butanone.

In addition, particulates of metal or metal oxide are preferably added to the undercoating layer 24 to adjust the conductivity and prevent moiré. Especially, titanium oxide is preferably used.

Particulates are dispersed in a solvent such as tetrahydrofuran, cyclohexanone, dioxane, dichloroethane or butanone with a ball mill, an attritor, or a sand mill to form a liquid application mixture of liquid dispersion and resin component.

The undercoating layer 24 is formed on the electroconductive substrate 21 by a dip coating method, a spray coating method, or a bead coating method and optionally cured by heating.

The layer thickness of the undercoating layer 24 is suitably from about 2 to about 5 μm. When an image bearing member tends to have a high residual voltage, the layer thickness thereof is preferred to be less than 3 μm.

The photosensitive layer in the present invention suitably employs a laminar structure of the charge generation layer 25 and the charge transport layer 26 thereon.

Charge Generation Layer

The charge generation layer 25 is described among the layers of an image bearing member having a laminate structure.

The charge generation layer 25 is a part of the laminar photosensitive layer and has a function of generating charges by irradiation of light. This layer is mainly formed of a charge generation material. The charge generation layer contains a binder resin, if desired. Inorganic material and organic material can be used as the charge generation material.

Specific examples of the inorganic materials include crystal selenium, amorphous-selenium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used.

Known materials can be used as the organic materials. Specific examples thereof include, but are not limited to, metal phthalocycnine such as titanyl phthalocyanine, chlorogallium phthalocyanine, non-metal phthalocyanine, azulenium salt pigments, squaric acid methine pigments, symmetric or asymmetric azo pigments having a carbazole skeleton, symmetric or asymmetric azo pigments having a triphenyl amine skeleton, symmetric or asymmetric azo pigments having a fluorenone skeleton, and perylene pigments. Among these, metal phthalocycnine, symmetric or asymmetric azo pigments having a triphenyl amine skeleton, symmetric or asymmetric azo pigments having a fluorenone skeleton, and perylene pigments are preferably used in the present invention since all of these have high quantum efficiency of charge generation. These charge generation materials may be used alone or in combination.

Specific examples of the binder resins optionally used in the charge generation layer 25 include, but are not limited to, polyamides, polyurethanes, epoxy resins, polyketones, polycarbonates, polyarylates, silicone resins, acrylic resins, polyvinylbutyrals, polyvinylformals, polyvinylketones, polystyrenes, poly-N-vinylcarbazoles, and polyacrylamides. In addition, charge transport polymers, which are described later, can be also used. Among these, polyvinyl butyral is most used and useful. These binder resins can be used alone or in combination.

The method of forming a charge generating layer is typified into a vacuum thin-film forming method and a casting method using a liquid dispersion. Specific examples of the vacuum thin-film forming methods include, but are not limited to, a vacuum evaporation method, a glow discharge decomposition method, an ion-plating method, a sputtering method, a reactive sputtering method, or a chemical vapor deposition (CVD) method. Charge generation layers can be preferably formed by these method using the above-mentioned inorganic material(s) or organic material(s).

In the casting method, the above-mentioned inorganic or organic charge generation material is dispersed with a binder resin in a solvent, for example, tetrahydrofuran, cyclohexanone, dioxane, dichloroethane, and butanone by, for example, a ball mill, an attritor, and a sand mill. Thereafter, suitably diluted liquid dispersion is applied to the surface of a substrate to form the charge generation layer. Among these solvents, methylethyl ketone, tetrahydrofuran, and cyclohexanone are preferred in comparison with chlorobenzene, dichloromethane, toluene and xylene in terms of the burden on the environment. The diluted liquid dispersion can be applied by a dip coating method, a spray coating method, a bead coating method, etc. The thickness of the charge generation layer is suitably from about 0.01 to about 5 μm.

The charge generation layer is thickened to reduce the residual voltage or improve the sensitivity. However, the chargeability may deteriorate in terms of maintainability of the charge and the formation of space charge. Considering the balance between these, the thickness of the charge generation layer is preferably from 0.05 to 2 μm.

In addition, a compound having a low molecular weight and a leveling agent such as an anti-oxidant, a plasticizer, a lubricant, and an ultraviolet absorption agent, which are described later, can be added to the charge generation layer 25, if desired. These compounds can be used alone or in combination. However, when a compound having a low molecular weight and a leveling agent are used in combination, the sensitivity of the charge generation layer easily deteriorates in most cases. Therefore, the addition amount of the compound having a low molecular weight is generally from about 0.1 to about 20 phr and preferably from about 0.1 to about 10 phr and the addition amount of the leveling agent is from about 0.001 to about 0.1 phr.

Charge Transport Layer

The charge transport layer 26 is a part of the laminar photosensitive layer and has a function of neutralizing the surface charge of an image bearing member generated by charging by infusing and transporting the charges generated in the charge generation layer 25. The main component of the charge transport layer 26 is a charge transport component and a binder component to bind the charge transport components.

Materials suitably used as the charge transport components are electron transport materials having a low molecular weight, a positive hole transport material having a low molecular weight and a charge transport polymer.

Specific examples of the electron transport materials include, but are not limited to, electron acceptance materials such as an asymmetry diphenoquinone derivative, a fluorenone derivative, and naphthalimide derivative.

These electron transport materials can be used alone or in combination.

Electron donating materials are suitably used as the positive hole transport materials.

Specific examples of the positive hole transport materials include, but are not limited to, oxazole derivatives, oxadiazole derivatives, imidazole derivatives, triphenyl amine derivatives, butadiene derivatives, 1,1-bis-(4-dibenzyl aminophenyl)propane, styryl anthracene, styryl pyrazoline, phenyl hydrazones, α-phenylstilbene derivatives, thiazole derivatives, triazole derivatives, phenazine derivatives, acridine derivatices, benzofuran derivatives, benzimidazole derivatives, and thiophene derivatives.

These positive hole transport materials can be used alone or in combination.

In addition, the following charge transport polymers can be also used: polymers having a carbazole ring such as poly-N-vinyl carbazole; polymers having a hydrazone structure illustrated in JOP S57-78402, etc.; polysilyene polymers illustrated in JOP S63-285552, etc.; and aromatic polycarbonates illustrated in the chemical formulae (1) to (6) of JOP 2001-330973. These charge transport polymers can be used alone or in combination. The illustrated compounds in JOP 2001-330973 are preferable because those compounds have good electrostatic characteristics.

When the cross-linked resin surface layer is accumulated, the charge transport polymer oozes the component thereof to the cross-linked resin surface layer less than the charge transport material having a low molecular weight. Therefore, the charge transport polymer is a suitable material to prevent bad curing of the cross-linked resin surface layer. Furthermore, since the molecular weight of the charge transport polymer is large, the charge transport layer 26 has good heat resistance. Therefore, the charge transport polymer is advantageous in terms that the charge transport layer 26 is protected from the curing heat produced when the cross-linked resin surface layer is formed.

Specific examples of polymers suitably used as the binder components of the charge transport layer include, but are not limited to, thermoplastic resins or thermocuring resins such as polystyrenes, polyesters, polyvinyl, polyarylate, polycarbonates, acrylic resins, silicone resins, fluorine containing resins, epoxy resins, melamine resins, urethane resins, phenol resins, and alkyd resins. Among these, when polystyrenes, polyesters, polyarylates or polycarbonates are used as the binder component of the charge transport component, most of those polymers have good charge mobility and are thus useful. In addition, since the cross-linked resin surface layer is accumulated on the charge transport layer 26, the charge transport layer 26 is not required to have a mechanical strength, which is usually required for a typical charge transport layer. Therefore, a material such as polystyrene, which is highly transparent but slightly weak in terms of the mechanical strength, is unsuitable for use in a typical charge transport layer but can be effectively used as the binder component of the charge transport layer having the cross-linked resin surface layer.

These polymers can be used alone or in combination. In addition, a copolymer formed of two or more kinds of monomers or a compound copolymerized with the charge transport material can be used as the polymer.

When an electrically inactive polymer is used to reform the charge transport layer 26, using polyesters of Cardo polymer type having a bulky skeleton such as fluorine, polyesters such as polyethylene terephthalate and polyethylene naphthalate, polycarbonates in which 3,3' portion of the phenol component is substituted by an alkyl group for a polycarbonate of bisphenol type such as a C type polycarbonate; polycarbonates having biphenyl or biphenyl ether skeleton; polycarbonates having a long chain alkyl skeleton such as polycaprolactone (refer to JOP H07-292095, etc.); acrylic resins; polystyrenes; and hydrogenerated butadiene.

The electrically inactive polymer represents a polymer including no chemical structure having optical conductivity such as triaryl amine structure.

When these resins are used as additives in combination with a binder resin, the addition amount of these resins is preferably not greater than 50% by weight based on the entire solid portion of the charge transport layer 26 due to the constraint of the optical decay sensitivity.

When the electron transport material having a low molecular weight is used, the content thereof is from about 40 to about 200 phr and preferably from about 70 to about 100 phr. In addition, when the charge transport polymer is used, a material formed of copolymerization of the resin component with the charge transport component with a ratio of from 0 to about 200 parts by weight and preferably from about 80 to 150 parts by weight of the resin component based on 100 parts by weight of the charge transport component is suitably used.

Furthermore, when the charge transport layer 26 contains at least two kinds of charge transport materials, using the charge transport materials having a small ion potential difference from each other is preferred. To be specific, one charge transport material is prevented to be a charge trap for the other charge transport material (s) by making the difference in the ionization potentials thereof not greater than 0.10 eV.

This ionization potential relationship is applicable to the charge transport material contained in the charge transport layer and the curing charge transport material described later, i.e., the ionization potential difference therebetween is preferably to not to be greater than 0.10 eV.

The ionization potential of the charge transport material for use in the present invention is measured by a typical method using an atmosphere type ultraviolet photon analyzer (AC-1, manufactured by Riken Keiki Co., Ltd.)

To improve the sensitivity, the blend amount of the charge transport component is preferably 70 phr or higher. In addition, monomers or dimmers of α-phenyl stilbene compounds, benzidine compounds and butadiene compounds are suitable as the charge transport material and the charge transport polymer having such a structure in the main chain or branched chain are also preferred because these compounds tend to have a high charge mobility.

Specific examples of the solvent dispersion for use in preparing a liquid application for the charge transport layer 26 include, but are not limited to, ketones such as methylethyl ketone, acetone, methylisobutyl ketone and cyclohexanone, ethers such as dioxane, tetrahydrofuran and ethylcellosolve, aromatic compounds such as toluene and xylene, halogens such as chlorobenzene and dichloromethane and esters such as methyl acetate and butyl acetate. Among these, methylethyl ketone, tetrahydrofuran, and cyclohexanone are preferable in comparison with chlorobenzene, dichloromethane, toluene, and xylene since these solvents are less burden on the environment. These solvents can be used alone or in combination.

The charge transport layer is formed by dissolving or dispersing a mixture or a copolymer mainly formed of the charge transport component and the binder component followed by coating and drying of the resultant liquid. The employed application methods are, for example, a dip coating method, a spray coating method, a ring coating method, a roll coating method, a gravure coating method, a nozzle coating method and screen printing method.

Since the cross-linked resin surface layer is accumulated on the charge transport layer 26, the layer thickness of the charge transport layer 26 is determined without considering the layer scraping caused by actual usage.

The layer thickness of the charge transport layer 26 is suitably from about 10 to about 40 μm and preferably from about 15 to about 30 μm to secure the desirable sensitivity and charging power.

In addition, low molecular weight compounds and/or leveling agents such as an anti-oxidant, a plasticizer, a lubricant, an ultraviolet absorption agent, which are described later, can be added to the charge transport layer. These compounds can be used alone or in combination. When such a low molecular weight compound and a leveling agent are used in combination, the sensitivity of the image bearing member tends to deteriorate in most cases. Therefore, the addition amount of these compounds is suitably from about 0.1 to about 20 phr, and preferably from about 0.1 to about 10 phr and the addition amount of the leveling agent is suitably from about 0.001 to about 0.1 phr.

Cross-Linked Resin Surface Layer

The cross-linked resin surface layer represents a protective layer coated on the surface of an image bearing member. This protective layer is formed as a resin having a cross-linked structure due to the polycondensation reaction after the liquid application is coated on the surface of an image bearing member. Due to the cross-linked structure, the resin layer is the strongest of all the layers of the image bearing member with regard to anti-abrasion. In addition, since the charge transport material having cross-linking property is blended, the resin layer tends to have a charge transport property similar to that of the charge transport layer 26.

To improve the acceptability of the solid lubricant on the surface of an image bearing member, the cross-linked surface layer contains a cross-linked body of trimethylol propane triacrylate in the present invention, thereby, reducing the occurrence of the image flow ascribable to containing particulates containing silicon in the surface of the image bearing member. In addition, the obtained image bearing member resultantly has good anti-abrasion property.

In addition, to have an average diameter of the agglomeration area of the particulates containing silicon in the surface of the cross-linked resin surface layer from 0.5 to 2.2 μm, mixing two or more kinds of particulates containing silicon having different average particle diameters is preferred. To be specific, it is preferred to mix particulates containing silicon having an average particle diameter of from 0.08 to less than 0.5 μm. Especially, mixing particulates containing silicon such that the content ratio of the particulates containing silicon having an average particle diameter of from 0.08 to 0.12 μm is the highest among all is preferred. Furthermore, the average particle diameter of the mixture of the particulates containing silicon is preferably from 0.10 to 0.70 μm. More preferably, the occupation area ratio of the mixed filler contained in the cross-linked surface layer is from 2 to 10%, thereby improving the acceptability of the solid lubricant.

Radical Polymerizable Material Component

The binder component having three or more functional groups preferably contains caprolactone modified dipentaerythritol hexaacrylate or dipentaerythritol hexaacrylate, thereby improving the anti-abrasion property of the cross-linked layer or increasing the strength inmost cases.

As the radical polymerizable monomer having three or more functional groups without a charge transport structure, trimethylol propane triacrylate, caprolactone modified dipentaerythritol hexaacrylate, and dipentaerythritol hexaacrylate are preferred. Especially, trimethylol propane triacrylate is excellent and useful to improve the anti-abrasion property of the surface of the image bearing member. These compounds are available from reagent manufacturers such as Tokyo Chemical Industry Co., Ltd. and Nippon Kayaku Co., Ltd. (KAYARAD DPCA series and KAYARAD DPHA series). An initiator such as IRGACURE 184, etc., manufactured by Ciba Specialty Chemical K.K., can be added to the radical polymerizable monomer in an amount of from about 5 to about 10% by weight based on all the solid portions.

Particulates Containing Silicon

Silica powder (KMPX-100, prepared by hydrophobizing amorphous silica available from Shin-Etsu Chemical Co., Ltd.) and highly pure synthesis spherical silica (SO-E1, SO-C1, SO-E2 and SO-C2, marketed by Admatechs Co., Ltd.) can be preferably used as the particulates containing silicon for use in the present invention. Also, for example, TOSPERAL 103 and TOSPEARL 105 (manufactured by Momentive Performance Materials Inc.) and TORAFILL R-925 (manufactured by Dow Corning Toray Silicone Co., Ltd.) can be used as silicon resin powder.

Method of Manufacturing

The particulates containing silicon can be pulverized and dispersed by, for example, a ball mill, a sand mill, a KD mill, a three roll mill, an pressure type homogenizer, or ultrasonic dispersion. When inorganic fillers having a large particle diameter are present in a large amount, the acceptability of the solid lubricant on the surface of an image bearing member instantly deteriorates. Therefore, when the particulates containing silicon is pulverized or dispersed, the average particle diameter of the mixed particulates containing silicon is preferably less than 0.5 μm. In addition, when the particulates containing silicon is excessively pulverized, reagglomeration of the particulates containing silicon occurs in the dispersion process of the particulates containing silicon, which may result in production of the particulates containing silicon having an extremely large domain size. Thus, the average particle diameter of the inorganic filler for use in the present invention is preferably greater than 0.1 μm. When the mixed filler has an average particle diameter of from about 0.1 to about 0.7 μm, the acceptability of the solid lubricant on the surface of an image bearing member is secured.

The liquid dispersion for use in preparation of a liquid application for the cross-linked surface layer is preferably a solvent which sufficiently dissolves monomers. Specific examples thereof include, but are not limited to, cellosolves such as ethoxyethanol, and propylene glycols such as 1-methoxy-2-propanol in addition to the ethers, the aromatic compounds, the halogens and the esters specified above. Among these, methylethyl ketone, tetrahydrofuran, cyclohexanone and 1-methoxy-2-propanol are preferable in comparison with chlorobenzene, dichloromethane, toluene, and xylene since these are less burden on the environment. These solvents can be used alone or in combination.

The application methods employed for coating the cross-linked surface layer are, for example, a dip coating method, a spray coating method, a ring coating method, a roll coating method, a gravure coating method, a nozzle coating method and screen printing method. Since the liquid application does not have a long pot life in most cases, the method which can cover the required coating in a small amount of liquid application is advantageous in light of the care for the environment and the cost. Among the methods specified above, the spray coating method and the ring coating method are preferred.

When the cross-linked surface layer is formed, a high pressure mercury lamp having an oscillation wavelength mainly in the ultraviolet range or an ultraviolet irradiation light source such as a metal halide lamp can be used. In addition, a visible radiation light source can be also selected according to the absorption wavelength of a radical polymeric compound and an optical polymerization initiator. The irradiation amount is preferably from 50 to 1,000 mW/cm$^2$. When the irradiation amount is too small, it tends to take a long time to complete curing reaction. To the contrary, when the irradiation amount is too large, the reaction tends to not uniformly proceed and thus the surface of the cross-linked surface layer locally wrinkles or a great number of non-reacting residual groups and reaction terminated ends are created. Furthermore, the internal stress increases due to rapid cross-linking, which may cause cracking and peeling of the layer.

If desired, low molecular weight compounds and/or leveling agents such as the anti-oxidant, the plasticizer, the lubricant, the ultraviolet absorption agent specified in the description of the charge generation layer 25, and the polymers specified in the description of the charge transport layer 26 can be added to the cross-linked resin surface layer. These compounds can be used alone or in combination. When such a low molecular weight compound and a leveling agent are used in combination, the sensitivity of the image bearing member tends to deteriorate in most cases. Therefore, the addition amount of these compounds is suitably from about 0.1 to about 20% by weight and preferably from about 0.1 to about 10% by weight and the addition amount of the leveling agent is suitably from about 0.1 to about 5% by weight based on the total solid portion of the liquid application.

The layer thickness of the cross-linked surface layer is suitably from about 3 to about 15 μm. The lower limit is calculated according to the degree of effect with regard to the layer forming cost and the upper limit is set by the electrostatic characteristics such as charging stability and optical decay sensitivity and the uniformity of the layer quality.

Image Forming Apparatus

The image forming apparatus of the present invention is described with reference to the accompanying drawings. A device to apply a solid lubricant, which is described later, to the surface of the image bearing member is provided to the image forming apparatus. For simplification, this device is described after the image forming apparatus is described.

Figure 8:
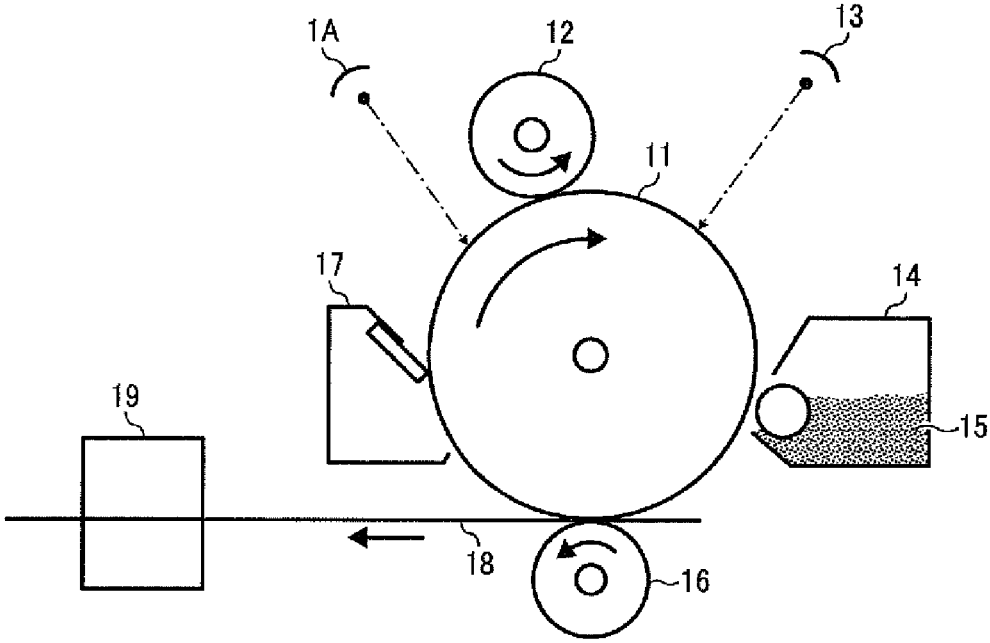
FIG. 8 is a schematic diagram illustrating an example of the cross section of the image forming apparatus of the present invention.

FIG. 8 is a schematic diagram illustrating the image forming apparatus of the present invention and the variant examples described later are also within the scope of the present invention.

An image bearing member 11 illustrated in FIG. 8 is an electrophotographic image bearing member (photoreceptor) in which a cross-linked surface layer is accumulated. The image bearing member 11 has a drum form but can also employ a sheet form or an endless belt form.

Any known charging device such as a corotron, a scorotron, a solid state charger, and a charging roller can be employed as the charging device 12. A charging device which contacts or is provided in the vicinity of the image bearing member 11 is preferably used as the charging device 12 in terms of the reduction of the consumption energy. Among these, a charging mechanism provided in the vicinity of the image bearing member 11 with a suitable gap between the image bearing member 11 and the surface of the charging device 12 is preferable to prevent contamination of the charging device 12. Generally, the charger specified above can be used as a transfer device 16. A combination of a transfer charger and a separation charger is effectively used.

As the light source for use in an irradiation device 13 and a discharging device 1A, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used. In addition, various kinds of filters, for example, a sharp cut filter, a band pass filter, an infrared cut filter, a dichroic filter, a coherency filter and a color conversion filter can be used to irradiate the image bearing member 11 with light having only a desired wavelength.

Toner 15 for use in developing a latent electrostatic image on the image bearing member 11 by a development device 14 is transferred to a recording medium 18 such as printing paper and transparent sheet. However, some of toner 15 remains on the image bearing member 11 untransferred. Such residual toner remaining on the image bearing member 11 is removed therefrom by a cleaning device 17. The cleaning device 17 can employ a rubber cleaning blade, a brush such as a fur brush and a magnet fur brush, etc.

When the image bearing member 11 is positively (negatively) charged followed by irradiation according to obtained data information, a positive (negative) latent electrostatic image is formed on the image bearing member 11. When the latent electrostatic image is developed with negatively (positively) charged toner (electric detecting particulates), a positive image is obtained. When the latent electrostatic image is developed with a positively (negatively) charged toner, a negative image is obtained. A typically used method is employed for the development device 14 and a discharging device 19 as well.

Figure 9:
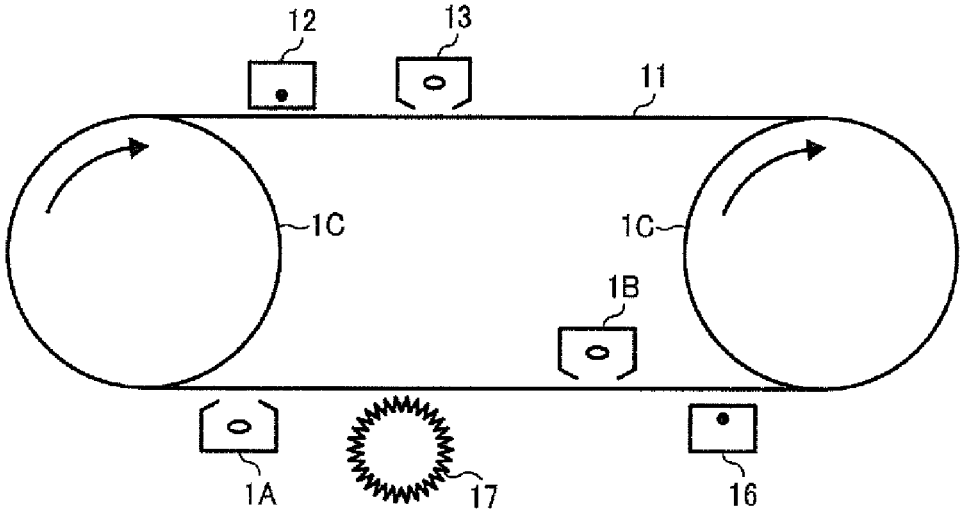
FIG. 9 is a schematic diagram illustrating another example of the cross section of the image forming apparatus of the present invention.

FIG. 9 is a diagram illustrating another example of the electrophotographic process according to the present invention. In FIG. 9, the image bearing member 11 has a belt form but can also employ a drum form or a sheet form. The image bearing member 11 is driven by a driving device 1C and charged by the charging device 12, irradiated by the irradiation device 13 according to obtained image information, developed (not shown), transferred by the transfer device 16, preliminarily irradiated before cleaning by a prior to cleaning irradiation device 1B, cleaned by the cleaning device 17, and discharged by the discharging device 1A and these processes are repeated. In FIG. 9, the image bearing member is preliminarily irradiated before cleaning from the side of the substrate thereof. The substrate is translucent in this case.

The electrophotographic processes described above are illustration only and other embodiments are applicable to the image forming apparatus of the present invention. For example, the image bearing member 11 is preliminarily irradiated before cleaning from the side of the substrate thereof but can be irradiated from the side of the photosensitive layer of the image bearing member 11. In addition, image irradiation and irradiation for discharging can be performed from the side of the substrate. With regard to the light irradiation processes, image irradiation, preliminary irradiation before cleaning and irradiation for discharging are illustrated. Other irradiation processes can be also employed, for example, irradiation before transfer, preliminary irradiation before image irradiation, and other known irradiation processes can be employed to irradiate the image bearing member 11.

Figure 10:
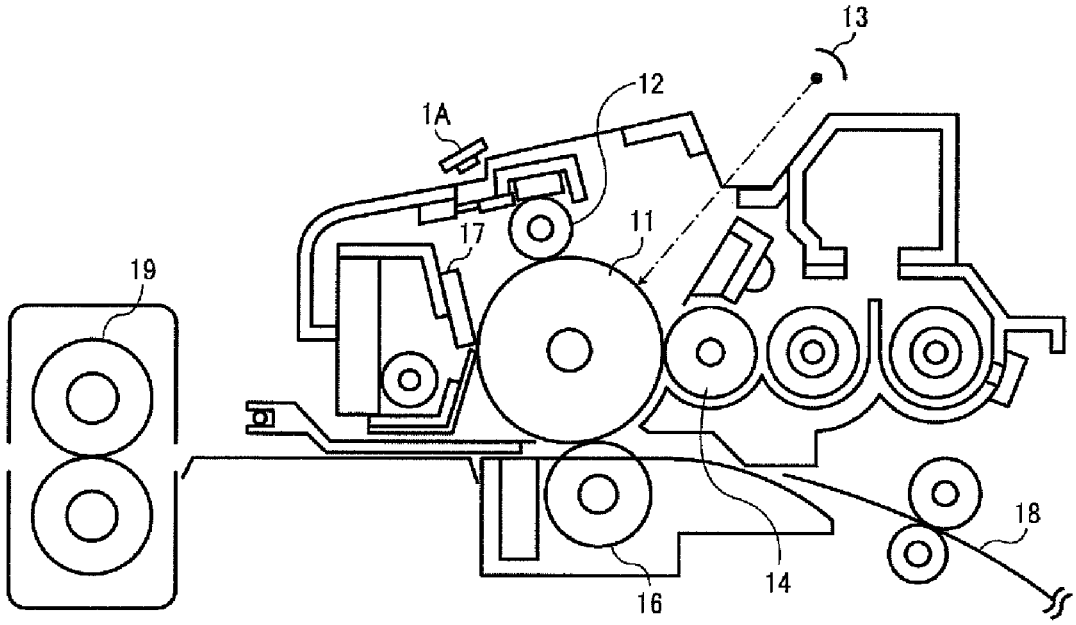
FIG. 10 is a schematic diagram illustrating another example of the cross section of the image forming apparatus of the present invention.

In addition, the image formation device as illustrated above can be integrated into a photocopier, a facsimile machine, or a printer in a fixed manner or a form of a process cartridge. The process cartridge has various kinds of forms and FIG. 10 is a diagram illustrating a typical example of the process cartridge. The image bearing member 11 employs a drum form in FIG. 10 but can also employ a sheet form or an endless form.

Figure 11:
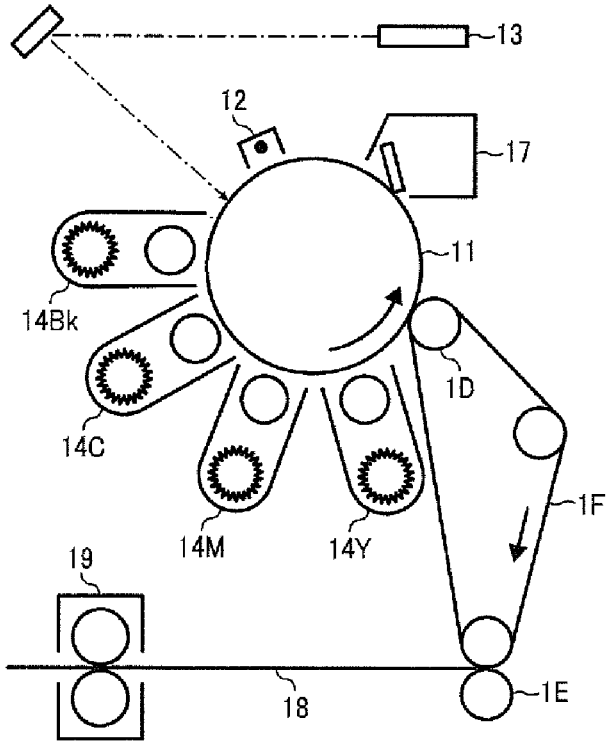
FIG. 11 is a schematic diagram illustrating another example of the cross section of the image forming apparatus of the present invention.

FIG. 11 is a diagram illustrating another example of the image forming apparatus of the present invention. The image forming apparatus includes the image bearing member 11 around which the charging device 12, the irradiation device 13, the development devices (14Bk, 14C, 14M and 14Y) for respective color toners of black (Bk), cyan (C), magenta (M), and yellow (Y), an intermediate transfer belt 1F and the cleaning device 17 are provided. The letters of Bk, C, M and Y represent correspondingly the color names mentioned above and are suitably omitted occasionally. The image bearing member 11 is an electrophotographic photoreceptor having a cross-linked surface layer. Each color development device (14Bk, 14 C, 14M and 14Y) is independently controllable and thus it is only the development devices required for image formation that are driven. The toner image formed on the image bearing member 11 is transferred to an intermediate transfer belt 1F by a first transfer device 1D located inside the intermediate transfer belt 1F. The first transfer device 1D is detachably attachable to the image bearing member 11 and brings the intermediate transfer belt 1F into contact with the image bearing member 11 only during image transfer. Each color toner image is sequentially formed and overlapped on the intermediate transfer belt 1F. The overlapped toner image is transferred to the recording medium 18 at one time by a second transfer device 1E and thereafter fixed thereon by the fixing device 19 to form an image. The second transfer device 1E is also situated in a detachably attachable manner as to the intermediate transfer belt 1F and is brought into contact therewith only during image transfer.

In an image forming apparatus employing a transfer drum system, each color toner image is sequentially transferred to a transfer medium electrostatically attached to the transfer drum. Therefore, using thick paper is unsuitable. However, in an image forming apparatus having an intermediate transfer system as illustrated in FIG. 11, each color toner image is overlapped on the intermediate transfer body 1F. Therefore, there is no limit with regard to the kind of transfer media. This intermediate transfer system can be applied to not only the image forming apparatus illustrated in FIG. 11 but also the image forming apparatuses illustrated in FIGS. 8, 9 and 10 and the image forming apparatus of FIG. 12 (specifically illustrated in FIG. 13).

Figure 12:
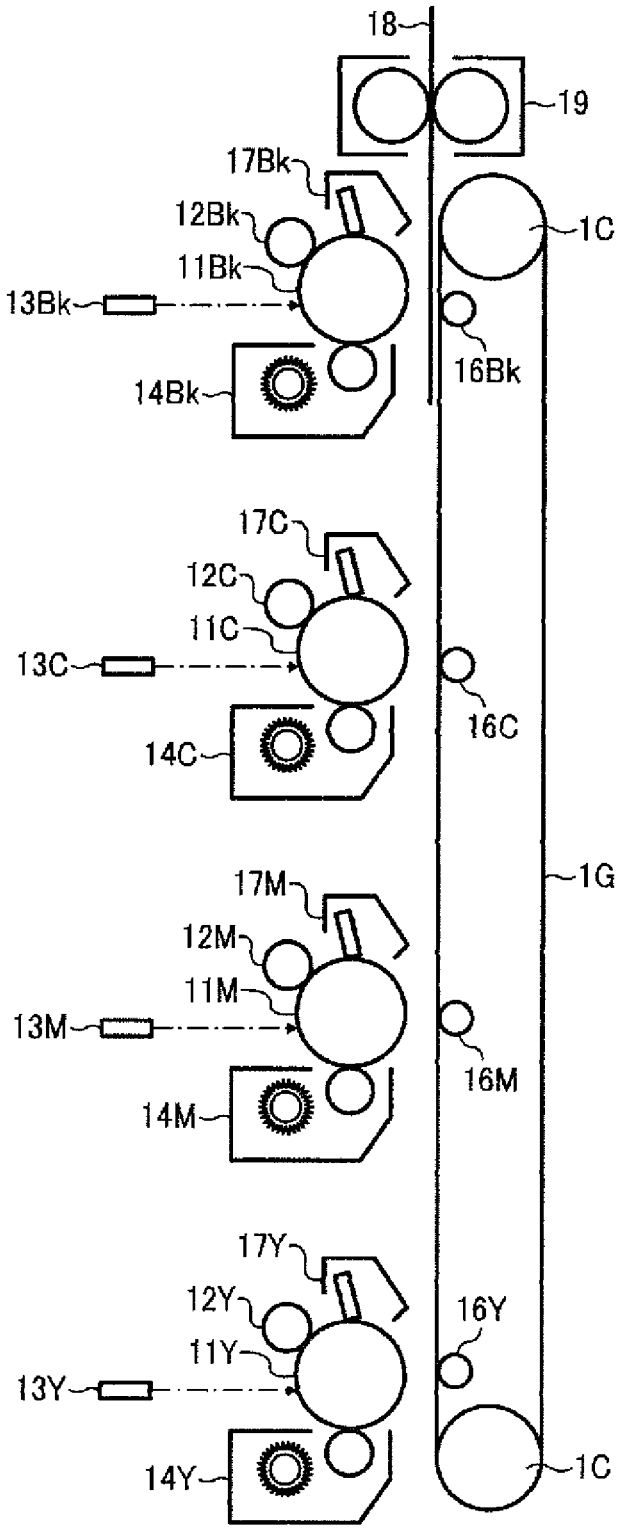
FIG. 12 is a schematic diagram illustrating another example of the cross section of the image forming apparatus of the present invention.
Figure 13:
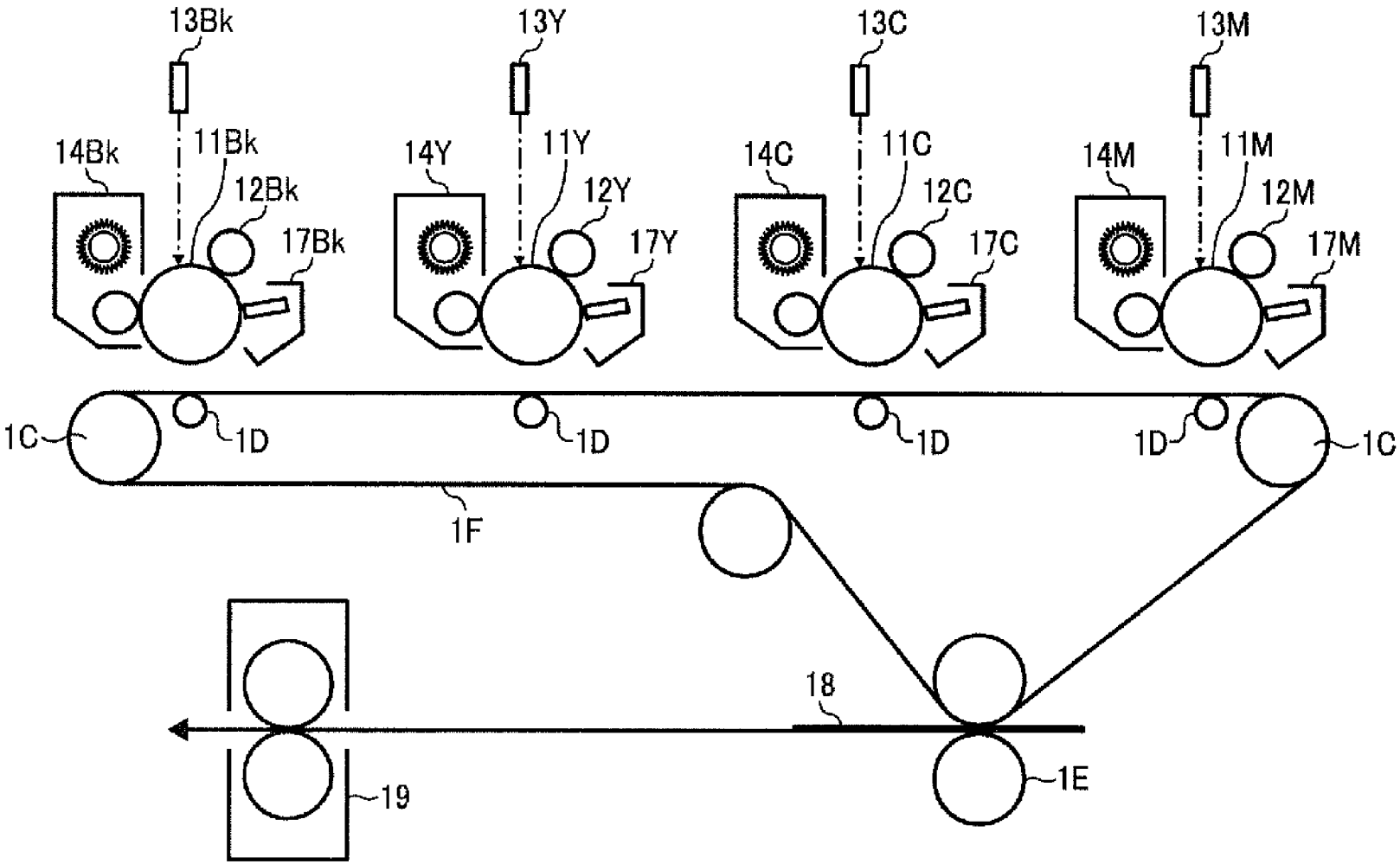
FIG. 13 is a schematic diagram illustrating another example of the cross section of the image forming apparatus of the present invention.

FIG. 12 is a diagram illustrating another example of the image forming apparatus of the present invention. This image forming apparatus uses four colors of yellow (Y), magenta (M), cyan (C) and black (Bk) and an image formation portion is provided for each color. In addition, image bearing members 11Y, 11M, 11C and 11Bk are provided for each color. The image bearing member 11 for use in the image forming apparatus is an electrophotographic photoreceptor having a cross-linked surface layer. The charging device 12, the irradiation 13, the development device 14, the cleaning device 17, etc. are provided around each image bearing member (11Y, 11M, 11C and 11Bk). In addition, a conveyor transfer belt 1G is suspended over the driving force 1C as a transfer material bearing body, which is detachably attachable at respective transfer positions of the image bearing members 11Y, 11*m*, 11C and 11Bk arranged along a straight line. The transfer device 16 is provided at the transfer position opposing the image bearing members 11Y, 11M, 11C and 11Bk with the conveyor transfer belt 1G therebetween.

The image forming apparatus having a tandem system as illustrated in FIG. 12 has image bearing members 11Y, 11M, 11C and 11Bk for respective colors and each color toner image is sequentially transferred to the recording medium 18 borne on the conveyor transfer belt 1G. Therefore, this image forming apparatus can output full color images at an extremely higher speed than a full color image forming apparatus having only one image bearing member.

Supply of Solid Lubricant

Figure 16:
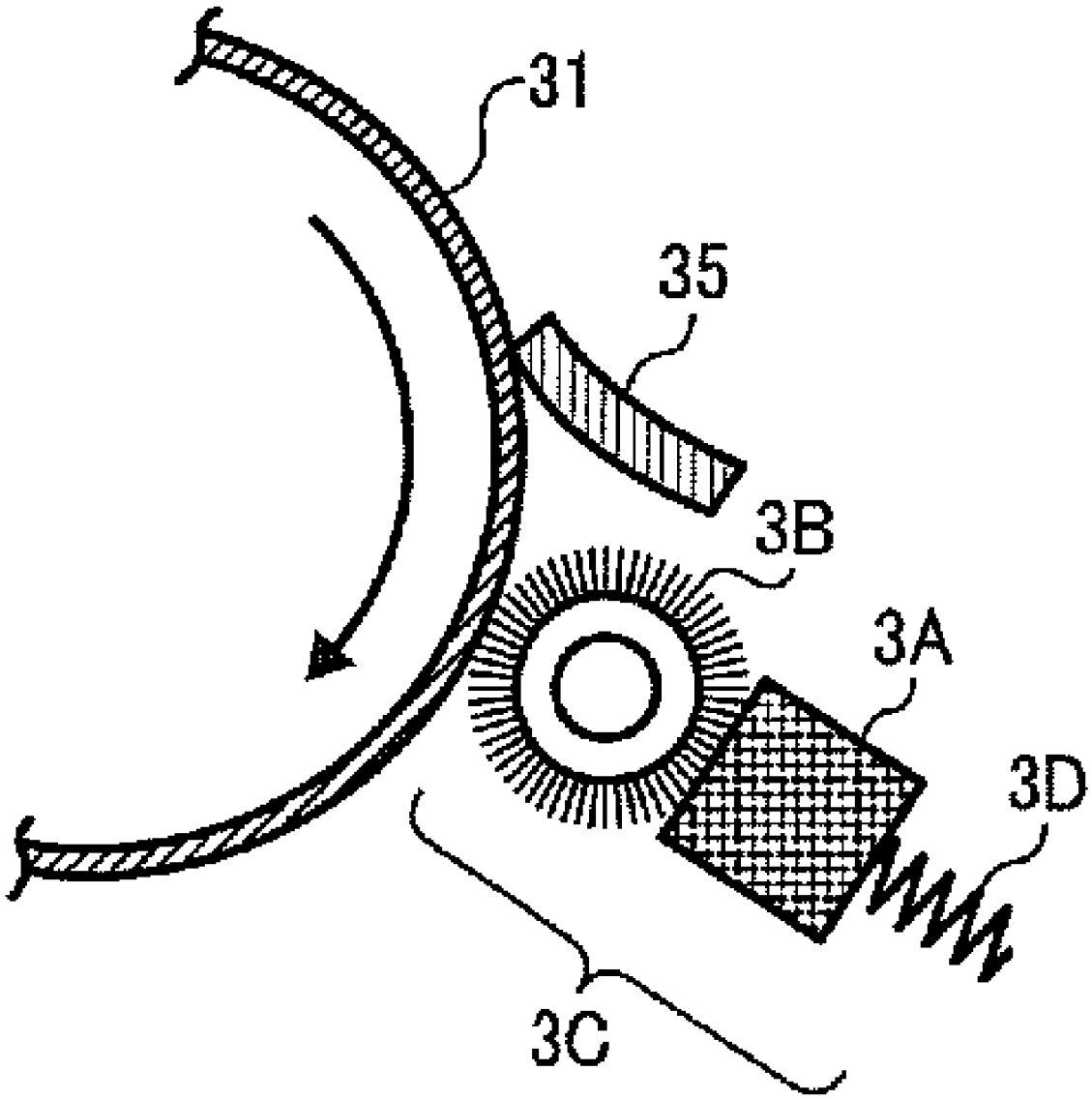
FIG. 16 is a cross section illustrating an example of the device which supplies a solid lubricant to the image bearing member for use in the present invention.

In the present invention, a lubricant application device is provided to each of the image forming apparatus described above is provided as a lubricant supply device 3C which supplies a lubricant 3A as illustrated in FIG. 16. This lubricant application device includes a fur brush 3B as an applicator, a solid lubricant 3A, and a pressure spring 3D to press the solid lubricant in the fur brush direction. The solid lubricant 3A is a solid lubricant molded to have a bar form. The front end of the fur brush 3B is in contact with the surface of an image bearing member 31 and rotates around its axis to take up, hold and convey the solid lubricant 3A to the contact position with the surface of the image bearing member 31 to apply the solid lubricant 3A thereto.

Furthermore, the solid lubricant 3A is scraped and reduced by the fur brush 3B over time but the pressure spring 3D constantly presses the solid lubricant 3A to the side of the fur brush 3B with a predetermined pressure to keep the solid lubricant 3A in contact with the surface of the image bearing member 31. Thereby, when the solid lubricant 3A is diminished to a minute amount, the fur brush can uniformly and constantly take up the solid lubricant 3A to the fur brush 3B.

In addition, a solid lubricant fixing device can be provided to improve the fixing property of the solid lubricant attached to the surface of the image bearing member 31. For example, a device having a board such as a cleaning blade can be provided in a trailing manner or a device such as a rubber roll pressed against an image bearing member can be used.

Specific examples of the solid lubricant 3A include, but are not limited to, aliphatic metal salts such as lead oleate, zinc oleate, copper oleate, zinc stearate, cobalt stearate, iron stearate, copper stearate, zinc palmitate, copper palmitate, and zinc linolenate, and fluorine containing resins such as polytetrafluoroethylene, polychlorotrifluoroethylene, polyvinilidene-fluoride, polytrifluoro chloroethylene, dichloro difluoroethylene, copolymers of tetrafluoroethylene and ethylene, and copolymers of tetrafluoroethylene and oxafluoropropylene. Among these, metal salts of stearate are preferred and zinc stearate is more preferred to reduce the friction coefficient of the image bearing member 31.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is described with reference to Examples.

First, the tests and measuring methods related to the present invention are described.

(1) Test on Acceptability of Solid Lubricant

Figure 15:
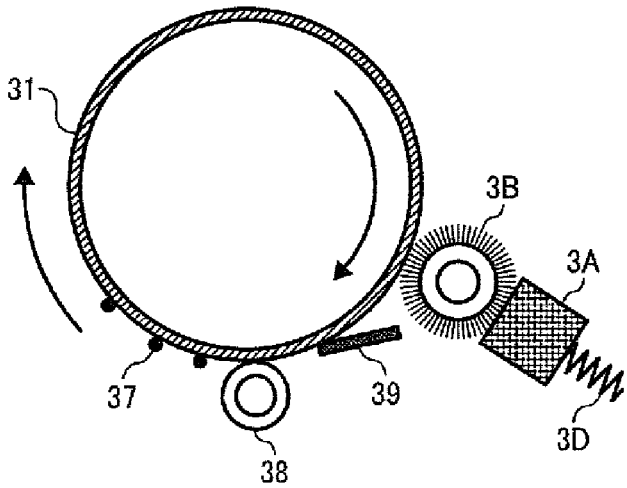
FIG. 15 is a diagram illustrating an example of the image bearing member and its surrounding to be measured for the acceptability of solid lubricant on the surface of the image bearing member.

The acceptability of solid lubricant on the surface of an image bearing member is evaluated by using a machine remodeled based on a color photocopier (imagio MP 450, manufactured by Ricoh Co., Ltd.). The color photocopier is remodeled in such a manner that some of the units around the image bearing member are removed to have the structure illustrated in FIG. 15.

To have the same conditions for the tests, unused and proper products of a solid lubricant bar of zinc stearate, a solid lubricant application brush, and a solid lubricant application blade are attached to a complex unit of the image bearing member (photoreceptor) unit and the development device unit. The color photocopier having the complex unit has a free running operation (i.e., idle running in which no image is formed) for 30 minutes so that the application brush is impregnated with the solid lubricant at the same level. In addition, the development agent in the development device unit is completely removed.

The image bearing members to be evaluated are observed for the surface thereof by a laser microscope (VK-8500, manufactured by Keyence Corporation). Next, the image bearing member is attached to the complex unit followed by the free running operation in the photocopier for 30 seconds. After this 30 second running, the image bearing member is collected and the surface thereof is observed with the laser microscope.

Figure 5:
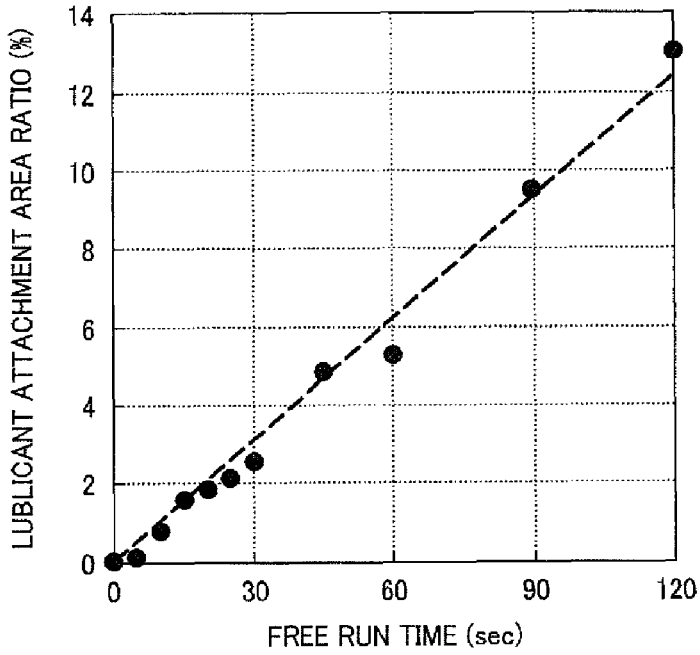
FIG. 5 is a graph illustrating an example of transition of the attachment area ratio of the lubricant based on the free running time.

According to the obtained image, the solid lubricant remaining on the image bearing member is distinguished from the surface of the image bearing member and the domain size and the area occupation ratio of the solid lubricant are calculated by using an image analysis software (ImagePro-Plus Ver. 3.0, manufactured by MediaCybernetics Co., Ltd.) with Measure and Count commands. FIG. 5 is a graph illustrating an example of the measuring results. The acceptability of solid lubricant on the surface of an image bearing member is evaluated based on the area ratio measured immediately after the free running operation of 30 seconds.

(2) Calculation of Domain Size of Mixed Filler

When the surface of an unused image bearing member is observed with the laser microscope (VK-8500, manufactured by Keyence Corporation), polka-dots as illustrated in FIGS. 1 and 2 are observed. When the area ratio of this polka-dot and the content of the mixed filler are plotted, a linear relationship is obtained. Therefore, this is determined as the agglomeration area (domain) of the mixed filler. The area ratio is obtained in the same manner as described above.

(3) Measuring Slip-Through Strength

The slip-through strength in the present invention is described first.

The slip-through strength in the present invention represents the amount of toner which slips through a cleaning blade in the process of collecting the toner attached to the image bearing member with a cleaning blade. The toner which has slipped through the cleaning blade is collected by a white felt having a size of 8 mm×310 mm with a thickness of 1 mm (manufactured by Tsuchiya Co, Ltd. and hereinafter referred to as a slip-through toner catcher), which is provided on the downstream side of the cleaning blade and the upstream side on the opening mouth of the development device. the white felt is made in contact with the image bearing member.

The contamination degree of the white felt is converted into digital data by an image scanner and the shading (image density) is classified into 5 levels. The area (image area ratio) of each density classified into 5 levels is obtained and the slip-through strength is calculated according to the following relationship (1):

$$\text{(Slip-through strength: } T\text{)=(Image area ratio: } \Sigma\text{)}\times\text{(Image density)} \qquad \text{Relationship (1)}$$

The image density is almost in proportion to the existing amount of the toner per minute area unit. Therefore, when respective area ratios are reflected in each particular image density (5 levels) and the obtained 5 results are added, the value almost equal to the total amount of toner which has slipped through the cleaning blade is obtained. Also the slipped through toner is collected and the weight thereof can be measured. However, the contamination degree of an image has a stronger relationship with the optical density brought by the slipped through toner than the weight thereof. "almost in proportion to" and "the value almost equal to" have such a meaning. The mechanism is considered to be that the total weight of the slipped-through toner does not reflect the particle size distribution status of toner particles constituting the toner. The image area ratio and the image density are measured by using an image analysis software (ImageProPlus Ver. 3.0, manufactured by MediaCybernetics Co., Ltd.) with Pseudo-Color command. The slip-through strength is from the minimum of 0 to the maximum of 500.

Figure 14:
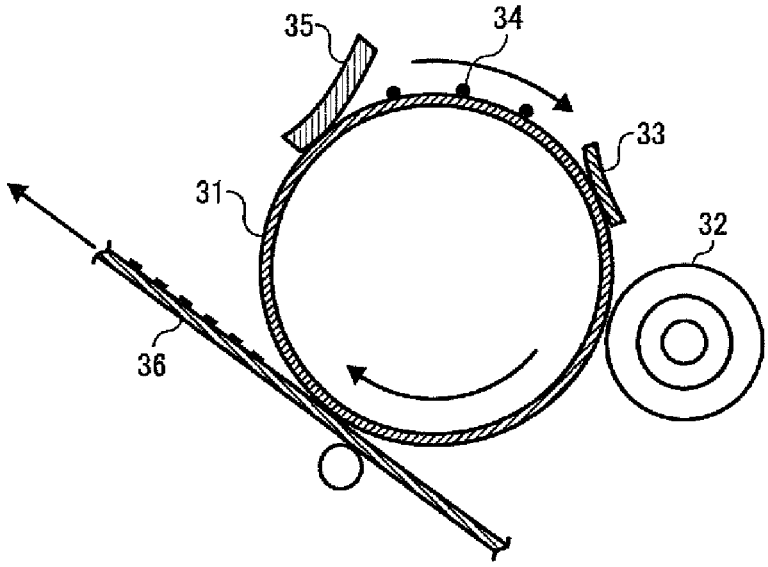
FIG. 14 is a diagram illustrating an example of the image bearing member and its surrounding to be measured for the slip-through strength.

For the test, an image bearing member 31, a cleaning blade 35, a development roller (development device) 32, a slip-through catcher 33 are attached to an image forming apparatus to have the structure illustrated in FIG. 14. A numeral reference 34 represents toner which has slipped through the cleaning blade 35. The amount of toner supplied from the development roller 32 to the image bearing member 31 is controlled to be the same by adjusting the charging voltage, the development bias and the amount of writing light. Then, an image 36 having an image density of 5% is consecutively output on 50 A4 sheets. Thereafter, the slip-through toner catcher is collected and the slip-through strength is calculated according to the method described above.

A slip-through strength that is too strong easily causes filming on the surface of the image bearing member. On the other hand, when the slip-through strength is too weak, the cleaning blade is drawn into the rotation of the image bearing member so that the cleaning blade may turn inward or an excessive amount of toner slips through the cleaning blade. The slip-through strength is preferably from 5 to 50. When the slip-through strength is within this range, occurrence of streak toner filming can be avoided. Furthermore, a quality image without leaving a feel of background fouling is obtained when the slip-through strength is from 5 to 30.

(4) Image Evaluation

Copy images for the test chart for color (COLOR CHART C-5, available from Ricoh Co., Ltd.) are output and evaluated for the background fouling for extra margin (5 levels).

5: Extremely excellent
4: Excellent
3: Fair
2: Slightly subdued but no practical problem
1: Subdued The test is actually performed according to the following sequence. An image bearing member set for measuring the slip-through strength is prepared by removing a cleaning brush, a charging roller cleaner, and a bar formed zinc stearate from the image bearing member set of imagio Neo C455 (manufactured by Ricoh Co., Ltd.). This image bearing member set is attached to the black development station. The DC bias among the bias applied by the charging roller of imagio Neo C455 is adjusted for the image bearing member to have a charging voltage of −700 V. Then, the amount of writing light is adjusted such that the voltage at the irradiation portion is −250 V. Solid patterns are written in this state while changing the development bias. The toner supplied to the image bearing member before transfer is collected by a transparent adhesive tape (Printac C, manufactured by Nitto Denko Corporation). Then, the image density of the tape is measured by a reflection spectrum densitomiter (X-RITE 939, manufactured by Canon I-tech Inc.) and the development bias is changed such that the image density is 1.0.

Next, a slip-through toner catcher (felt having a size of 8 mm×310 mm with a thickness of 1 mm, manufactured by Tsuchiya Co, Ltd.) is attached to the upper end of the opening of the development device with a line sponge tape (scotch tape 4016, manufactured by Sumitomo 3M Limited) having a thickness of 2 mm therebetween. This is attached to the main body.

An unused cleaning blade proper to imagio Neo c455 is used and a cleaned image bearing member are also attached. A test pattern image having an image density of 5% is continuously printed on 50 A4 sheets (My Paper A4, manufactured by NBS Ricoh Co., Ltd.) in an environment of 23° C. and 55% RH with proper toner (polymerization toner).

After printing, the slip-through toner catcher is collected and the image is digitized by using an image scanner (ES-8500, manufactured by Epson Corporation) with the following conditions:

Zoom: 100%
Color calibration by color driver: 1.0
Output: 800 dpi
Photograph: 800 dpi
Unsharp mask: middle
8 bit gray.

The image density and the area ratio of the slip-through toner catcher image data is calculated from the image data by using an image analysis software (ImageProPlus Ver. 3.0, manufactured by MediaCybernetics Co., Ltd.) with Pseudo-Color command with 5 divisions having an upper limit of 210 and a lower limit of 310. The sum of these values is calculated as the slip-through strength.

Example 1

A liquid application for an undercoating layer, a liquid application for a charge generation layer and a liquid application for a charge transport layer having the following recipe are sequentially applied to an aluminum drum having a length of 340 mm, an outer diameter of 40 mm and a thickness of 0.8 mm and another aluminum drum having a length of 340 mm, an outer diameter of 30 mm and a thickness of 0.8 mm followed by drying to form an undercoating layer of 3.5 μm, a charge generation layer of 0.2 μm and a charge transport layer of 24 μm thereon. On the charge transport layer, a liquid application for a cross-linked resin surface layer having the following recipe is applied by a spray. Thereafter, each of the drums is cured by ultraviolet by an ultraviolet curing lamp located 120 mm away from the drum while rotating the drum. The UV curing lamp illuminance at this position is 600 mW/cm$^2$, which is the value measured by an accumulated ultraviolet meter (UIT-150, manufactured by Ushio Inc.). The rotation speed of the aluminum drum is 25 rpm. The aluminum drum is rotated and continuously ultraviolet cured for 4 minutes while water at 30° C. is circulated in the aluminum drum. Thereafter, the drum is heated at 130° C. for 30 minutes and dried. As a result, the image bearing member having a cross-linked resin surface layer having a thickness of 4 μm is obtained. The occupation area ratio of the particulates containing silicon of the image bearing member is 12% and the domain size is 2.2 μm.

The liquid application for the cross-linked resin surface layer is prepared as follows:

A mixed filler having a solid portion having a dispersion density of 10% by weight and a liquid dispersion of tetrahydrofuran are subject to a 2 hour dispersion treatment by a vibration shaker (manufactured by Ica Corporation) with partially stabilized zirconia (PSZ) balls. Separately, a vehicle of the liquid application for the cross-linked resin surface layer excluding the particulates containing silicon component having a suitable density is prepared. The liquid dispersion of the particulates containing silicon is collected and added to the vehicle to obtain the liquid dispersion.

Liquid Application for Undercoating Layer

| | |
|---|---|
| Alkyd resin solution (Beckolite M6401-50, manufactured by DIC corporation) | 12 parts |
| Melamine resin solution (Superbeckamine G-821-60, manufactured by DIC corporation) | 8 parts |
| Titanium oxide (CR-EL, manufactured by Ishihara Sangyo Kaisha, Ltd.) | 40 parts |
| Methylethyl ketone | 200 parts |

Liquid Application for Charge Transport Layer

| | |
|---|---|
| Z type polycarbonate (Panlite TS-2050, manufactured by Teijin Chemicals Ltd.) | 10 parts |
| Low molecular weight charge transport material having the following chemical structure | 7 parts |

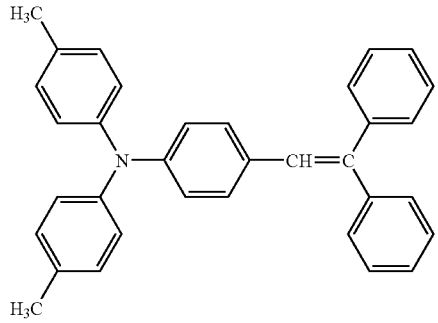

| | |
|---|---|
| Tetrahydrofuran | 100 parts |
| Tetrahydrofuran solution of 1% silicone oil (KF50-100CS, manufactured by Shin-Etsu Chemical Co., Ltd.) | 1 part |

Liquid Application for Charge Generation Layer

| | |
|---|---|
| Bisazo pigment having the following chemical structure (manufactured by Ricoh Co., Ltd.) | 5 parts |

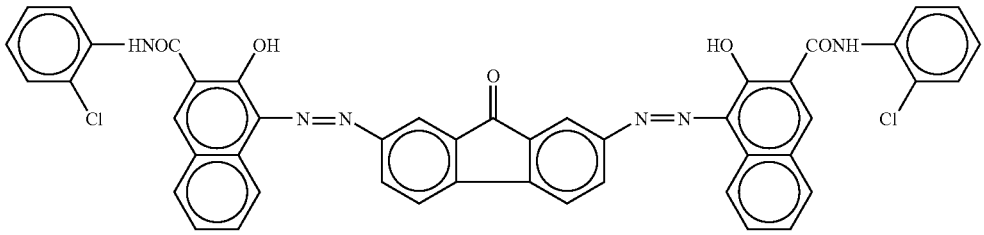

| | |
|---|---|
| Polyvinylbutyral (XYHL, manufactured by UCC) | 1 part |
| Cyclohexanone | 200 parts |
| Methylethyl ketone | 80 parts |

Liquid Application for Cross-Linked Resin Surface Layer

| | |
|---|---|
| Cross-linking type charge transport material having the following structure | 38 parts |
| Trimethylol propane triacrylate (KAYARAD TMPTA, manufactured by Nippon Kayaku Co., Ltd.) | 19 parts |
| Caprolactone-modified dipentaerythritol hexaacrylate (KAYARAD DPCA-120, manufactured by Nippon Kayaku Co., Ltd.) | 19 parts |
| Mixture of polyester-modified polydimethyl siloxane having an acryl group and propoxy-modified-2-neopentyl glycol diacrylate (BYK-UV3570, manufactured by BYK Japan KK) | 0.1 parts |
| 1-hydroxy cyclohexyl phenylketone (Irgacure 184, manufactured by Ciba Specialty Chemical K.K.) | 4 parts |
| Silica particulates (KMPX-100, average particle diameter: 0.1 μm, manufactured by Shin-Etsu Chemical Co., Ltd.) | 10 parts |
| Silica particulates (SO-E1, average particle diameter: 0.3 μm, manufactured by Admatechs Co., Ltd.) | 10 parts |
| Tetrahydrofuran | 400 parts |

The average particle diameter of the mixed filler in this Example is 0.2 μm.

Example 2

The image bearing member of Example 2 is manufactured in the same manner as in Example 1 except that the content of KMPX-110 contained in the liquid application for cross-linked resin surface layer of Example 1 is changed to 7.5 parts and the content of SO-E1 contained therein is changed to 7.5 parts. The average particle diameter of the mixed filler in this Example is 0.2 μm. The occupation area ratio of the mixed filler is 11.4% and the domain size thereof is 1.9 μm.

Example 3

The image bearing member of Example 3 is manufactured in the same manner as in Example 1 except that the content of KMPX-110 contained in the liquid application for cross-linked resin surface layer of Example 1 is changed to 5 parts and the content of SO-E1 contained therein is changed to 5 parts. The occupation area ratio of the mixed filler is 9% and the domain size thereof is 1.8 μm.

Example 4

The image bearing member of Example 4 is manufactured in the same manner as in Example 1 except that the content of KMPX-110 contained in the liquid application for cross-linked resin surface layer of Example 1 is changed to 4.0 parts and the content of SO-E1 contained therein is changed to 11 parts. The occupation area ratio of the mixed filler is 2% and the domain size thereof is 1.4 μm.

Example 5

The image bearing member of Example 5 is manufactured in the same manner as in Example 1 except that the content of KMPX-110 contained in the liquid application for cross-linked resin surface layer of Example 1 is changed to 10.5 parts and the content of SO-E1 contained therein is changed to 4.5 parts. The occupation area ratio of the mixed filler is 8% and the domain size thereof is 1.2 μm.

Example 6

The image bearing member of Example 6 is manufactured in the same manner as in Example 1 except that the content of KMPX-110 contained in the liquid application for cross-linked resin surface layer of Example 1 is changed to 13 parts and the content of SO-E1 contained therein is changed to 7.0 parts. The occupation area ratio of the mixed filler is 10.5% and the domain size thereof is 2.4 μm.

Comparative Example 1

The image bearing member of Comparative Example 1 is manufactured in the same manner as in Example 1 except that the content of KMPX-110 contained in the liquid application for cross-linked resin surface layer of Example 1 is changed to 15 parts and SO-E1 contained therein is changed to 5 parts of silicone resin powder (TOSPEARL 120, manufactured by Momentive Performance Materials Inc., Average particle diameter: 2 μm) The occupation area ratio of the mixed filler is 9% and the domain size thereof is 2.6 μm.

Comparative Example 2

The image bearing member of Comparative Example 2 is manufactured in the same manner as in Example 1 except that the content of KMPX-110 contained in the liquid application for cross-linked resin surface layer of Example 1 is changed to 20 parts and SO-E1 contained therein is not used. The occupation area ratio of the mixed filler is 17% and the domain size thereof is 3 μm.

Comparative Example 3

The image bearing member of Comparative Example 3 is manufactured in the same manner as in Example 1 except that 20 parts of aluminum particulates (AA-03, average particle diameter: 0.3 μm, manufactured by Sumitomo Chemical Co., Ltd.) is used instead of KMPX-110 and SO-E1 contained in the liquid application for cross-linked resin surface layer of Example 1. Alumina in the liquid application is inferior in terms of dispersion stability and settled out immediately after dispersion. When this liquid application is coated by a spray, the spray nozzle clogs with the aluminum filler during application so that a non-uniform layer is formed. Thus, the test is suspended.

Comparative Example 4

The image bearing member of Comparative Example 4 is manufactured in the same manner as in Example 1 except that the liquid application for the cross-linked resin surface layer of Example 1 is changed to the following:

Liquid Application for Filler Reinforced Charge Transport Layer

| | |
|---|---|
| Z type polycarbonate (Panlite TS-2050, manufactured by Teijin Chemicals Ltd.) | 10 parts |
| Charge transport material having a low molecular weight having the following chemical structure | 7 parts |

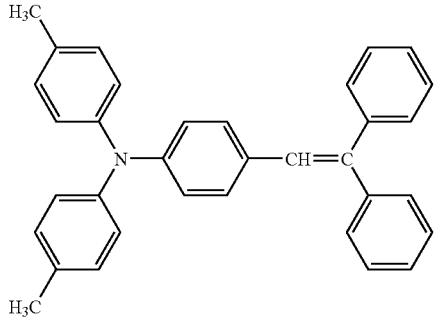

| | |
|---|---|
| Hydrophobized silica powder (KMP-X100, manufactured by Shin-Etsu Chemical Co., Ltd.) | 0.8 parts |
| Tetrahydrofuran | 280 parts |
| Cyclohexanone | 80 parts |

TABLE 1

| | Average particle diameter of mixed filler (μm) | Average domain size (μm) | Silica occupation area ratio (%) |
|---|---|---|---|
| Example 1 | 0.20 | 1.8 | 6.9 |
| Example 2 | 0.20 | 1.5 | 4.8 |
| Example 3 | 0.20 | 1.3 | 2.5 |
| Example 4 | 0.25 | 1.4 | 2.1 |
| Example 5 | 0.16 | 1.7 | 7.3 |
| Example 6 | 0.17 | 1.9 | 10.6 |
| Comparative Example 1 | 0.6 (single) | 2.3 | 11.0 |
| Comparative Example 2 | (0.1) | 2.4 | 14.8 |
| Comparative Example 3 | (0.3) | Suspended (Fail to manufacture) | Suspended (Fail to manufacture) |
| Comparative Example 4 | 0.1 (single) | 1.1 | 1.8 |

The thus manufactured image bearing members having a diameter of 40 mm of Examples 1 to 6 and Comparative Examples 1 to 4 are processed for installation and then installed to the yellow development station in an image forming apparatus (imagio MP450, manufactured by Ricoh Co., Ltd.) for the test for the acceptability of solid lubricant on the surface of an image bearing member. Zinc stearate (solid lubricant) attached to the proper part and its accompanying spring are used as they are.

The proper unit is used as the complex unit of the image bearing unit and the development device unit.

A voltage between peaks of 1.5 kV and a frequency of 0.9 KHz are selected as the AC component of the application voltage by the charging roller. In addition, the DC component is set to be a bias such that the charging voltage of the image bearing member at the initial stage of the test is −700 V and this charging condition is maintained until the test is complete. With regard to this apparatus, no discharging device is provided.

In addition, the thus manufactured image bearing members having a diameter of 30 mm of Examples 1 to 6 and Comparative Examples 1 to 4 are processed for installation and then installed to the black development station in an image forming apparatus (imagio MP450, manufactured by Ricoh Co., Ltd.). A half tone pattern having 4 dots by 4 dots in 8×8 matrix with a pixel density of 600 dpi (dot per inch) by 600 dpi is printed on copy paper (My paper A4, manufactured by NBS Ricoh Co., Ltd,) for a total run length of 200,000 sheets while consecutively printing the image 5 sheets by 5 sheets. Proper toner and development agent for imagio MP450 are used. The toner is a polymerization toner.

Also a proper image bearing member unit is used. A voltage between peaks of 1.5 kV and a frequency of 0.9 KHz are selected as the AC component of the application voltage by the charging roller. In addition, the DC component is set to be a bias such that the charging voltage of the image bearing member at the initial stage of the test is −700 V and this charging condition is maintained until the test is complete. The development bias is −500V. With regard to this apparatus, no discharging device is provided. Furthermore, a proper cleaning device is used and replaced with a new cleaning device every time the image is printed on 50,000 sheets to continue the test. After the test is complete, the color test chart is printed on PPC paper (TYPE-6200 A3). The test is performed in an environment of 10° C. and 15% RH.

The acceptability of solid lubricant on the surface of an image bearing member of Examples 1 to 6 and Comparative Examples 1 to 4 are shown in Table 2. The results of the image evaluation of the image bearing members manufactured in Examples 1 to 6 and Comparative Examples 1 to 4 after the test are shown in Table 3 together with the slip-through strength. When the image bearing member of Comparative Example 4 is used for the test in the same way as the other Examples and Comparative Examples, the image flow occurs and thus the test is suspended.

TABLE 2

| | Area ratio (%) of solid lubricant attached to the image bearing member |
|---|---|
| Example 1 | 11.0 |
| Example 2 | 11.5 |
| Example 3 | 13.3 |
| Example 4 | 9.0 |
| Example 5 | 10.0 |
| Example 6 | 6.5 |
| Comparative Example 1 | 2.5 |
| Comparative Example 2 | 2.8 |
| Comparative Example 3 | Suspended (fail to manufacture a layer) |
| Comparative Example 4 | 5.7 |

With regard to Examples 1 to 8 and Comparative examples 1 and 2, a good layer is easily formed on the image bearing member without a problem such that the filler in the liquid application is settled out. This is considered to be ascribable to the fact that the particulates containing silicon are used in the filler component of the cross-linked resin surface layer. In addition, a suitable layer is also formed by using trimethylol propane triacrylate.

In the image bearing members of Examples 1 to 6, silica particulates having an average particle diameter of 0.1 μm (KMP×100) and having an average particle diameter of 0.3 μm (SO-E1) are used as the particulates containing silicon having different average particle diameter. In addition, the filler having the largest occupation ratio (% by weight) among the mixed filler is both KMP×100 and SO E-1 with regard to Examples 1 to 3, only KMP×100 with regard to Examples 5 and 6, and only SOE1 with regard to Example 4.

The image bearing members of Examples 1 to 6 satisfy the conditions described above that the cross-linked resin surface layer includes a cross-linked body of trimethylol propane triacrylate and particulates containing silicon and the average diameter of agglomeration areas of the particulates containing silicon on the surface of the cross-linked resin surface layer is from 0.5 to 2.2 μm. Also a relatively efficient attachability is obtained for the image bearing members of Examples 1 to 6 in the acceptability test of solid lubricant on the surface of an image bearing member in comparison with Comparative Examples 1, 2 and 4.

The image bearing members of Examples 1 to 5 have the cross-linked resin surface layer also satisfying the condition described above that the occupation area ratio of the particulates containing silicon on the surface of the cross-linked resin surface layer is from 2 to 10%. Thus, the image bearing members of Examples 1 to 5 have a higher acceptability of solid lubricant than the image bearing member of Example 6, which does not satisfy the condition.

Roughening the surface of an image bearing member has been typically described to improve the application property of a solid lubricant. The status of the surface of an image bearing member is represented by the roughness parameter Rz (Value of Ten-Point Height of Irregularities measured by a surface roughness tester employing a sensing pin). However, Rz is a parameter representing the difference (height) between the convex and the concave. Therefore, various kinds of forms can be employed with the same Rz because Rz depends on the distance between the convex and the concave. Thus, even when Rz of the surface of an image bearing member is identified, the parameter is not effectively used to determine the applicability of a solid lubricant in a number of cases. In fact, the effect of improving the attachment of zinc stearate by blending the filler is not sufficient in Comparative Examples 2 and 3.

In these Comparative Examples, the surface layer of the image bearing member contains a single filler. In this method, the control factor to roughen the surface of an image bearing member is just the blend ratio. Changing a blend ratio generally leads to the variance in not only Rz and but also the distance between the concave and convex. Therefore, forming a rough surface status suitable to improve the attachability of zinc stearate is not easy. In this case, the number of the control factors to improve the attachability of zinc stearate is short.

With regard to the surface layer of an image bearing member containing a filler, the inventors of the present invention think that the agglomeration state of the filler has an impact on the characteristics of the rough state of the surface layer. The status of the agglomeration has a main relationship with the size of the agglomeration area and the occupation area ratio of the filler. Different kinds of fillers are preferably mixed to control these factors.

The image bearing members of Examples 1 to 6 obtained along this idea have a good acceptability of solid lubricant thereon.

Especially in Examples 1 to 5, the area ratio of the filler occupying in the surface of the image bearing member is specified and

TABLE 3

| | Image evaluation | Slip-through strength |
|---|---|---|
| Example 1 | 4 | 42 |
| Example 2 | 4 | 42 |
| Example 3 | 4 | 32 |
| Example 4 | 3 | 49 |
| Example 5 | 4 | 46 |
| Example 6 | 3 | 52 |
| Comparative Example 1 | 2 | 77 |
| Comparative Example 2 | 2 | 81 |
| Comparative Example 3 | Suspended (fail to manufacture image bearing member) | Suspended (fail to manufacture image bearing member) |
| Comparative Example 4 | 2 | 75 |

The image bearing members of Examples 1 to 6 in the present invention satisfy the conditions described above that the cross-linked resin surface layer includes a cross-linked body of trimethylol propane triacrylate and particulates containing silicon and the average diameter of agglomeration areas of the particulates containing silicon on the surface of the cross-linked resin surface layer is from 0.5 to 2.2 μm and thus the background fouling in the margin is limited in comparison with the image bearing members of Comparative Examples 1 to 4. It is also found that the slip-through strength values for Examples 1 to 6 are better than those for Comparative Examples 1 to 4.

Among these, the image bearing members of Examples 1 to 5 satisfy the condition described above that the occupation area ratio of the particulates containing silicon on the surface of the cross-linked resin surface layer is from 2 to 10% and produce more excellent images in comparison with the image bearing member of Example 6. The slip-through strength is also reduced to a low value. That is, the cleaning property of the polymerization toner is improved.

Furthermore, the image bearing members of Examples 1, 2, 3 and 5 satisfy the conditions described above that the particulates containing silicon in the cross-linked resin surface layer is a mixed filler containing at least two kinds of particulates containing silicon having a different average particle diameter, particulates containing silicon having a largest weight % in the mixed filler has an average particle diameter of from 0.08 to 0.12 μm, and the mixed filler has an average particle diameter of from 0.10 to 0.70 μm and produce particularly excellent images in comparison with the image bearing member of Example 4.

The image quality has correlation with the acceptability of solid lubricant on the surface of an image bearing member and thus the image bearing members of the present invention is excellent in terms of practical use which can stably produce quality images under a severe condition.

This document claims priority and contains subject matter related to Japanese Patent Application No. 2008-038335 filed on Feb. 20, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member comprising an electroconductive substrate, a photosensitive layer overlying the electroconductive substrate and a cross-linked resin surface layer overlying the photosensitive layer, the image bearing member configured to bear a latent electrostatic image on a surface thereof;

an application device configured to apply a solid lubricant to the image bearing member;

a charging device configured to charge the surface of the image bearing member;

an irradiation device configured to irradiate the surface of the image bearing member with light to form the latent electrostatic image thereon;

a development device configured to develop the latent electrostatic with toner to obtain a developed image;

a transfer device configured to transfer the developed image to a recording medium, and;

a cleaning device configured to clean the surface of the image bearing member, wherein the cross-linked resin surface layer comprises a cross-linked body of trimethylol propane triacrylate and particulates comprising silicon and an average diameter of agglomeration areas of the particulates comprising silicon on the surface of the cross-linked resin surface layer is from 0.5 to 2.2 μm;

wherein an occupation area ratio of the particulates comprising silicon on the surface of the cross-linked resin surface layer is from 2 to 10%;

wherein the particulates comprising silicon in the cross-linked resin surface layer are mixed fillers comprising at least two kinds of particulates comprising silicon having a different average particle diameter, particulates comprising silicon having a largest weight % of the mixed fillers has an average particle diameter of from 0.08 to 0.12 μm, and the mixed filler has an average particle diameter of from 0.10 to 0.70 μm;

wherein the particulates comprising silicon having the largest weight % of the mixed fillers are hydrophobized amorphous silica; and wherein the at least two kinds of particulates comprising silicon having a different average particle diameter comprise a spherical silica.

2. The image forming apparatus according to claim 1, wherein the cross-linked resin surface layer comprises a cross-linked body of a cured charge transport material represented by a following Chemical structure 1 in an amount of from 5% by weight to less than 60% by weight;

Chemical structure 1

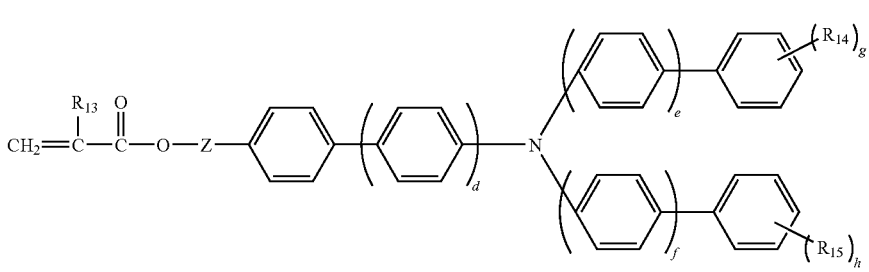

where d, e and f, each, independently represent 0 or 1, $R_{13}$ represents hydrogen atom or methyl group, $R_{14}$ and $R_{15}$, each, independently, represent an alkyl group having 1 to 6 carbon atoms, g and h, each, independently represent 0 or an integer of from 1 to 3, when g and h are 2 or 3, each of $R_{14}$ and $R_{15}$ can be independently different from each other, and Z represents a single bond, methylene group, ethylene group, —$CH_2CH_2O$—, —$CHCH_3CH_2O$— or a group represented by a following chemical formula:

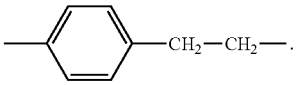

3. The image forming apparatus according to claim 1, wherein the solid lubricant is zinc stearate.

4. The image forming apparatus according to claim 1, wherein the toner is a polymerized toner.

5. A process cartridge comprising:

the image bearing member of claim 1; and an application device configured to apply a solid lubricant to the image bearing member.

6. The process cartridge according to claim 5, wherein the solid lubricant is zinc stearate.

* * * * *